US011847941B1

(12) United States Patent
Yarborough

(10) Patent No.: US 11,847,941 B1
(45) Date of Patent: Dec. 19, 2023

(54) SIGN WITH INSERTS

(71) Applicant: Maureen Yarborough, Collierville, TN (US)

(72) Inventor: Maureen Yarborough, Collierville, TN (US)

( * ) Notice: Subject to any disclaimer, the term of this patent is extended or adjusted under 35 U.S.C. 154(b) by 0 days.

(21) Appl. No.: 17/029,011

(22) Filed: Sep. 22, 2020

Related U.S. Application Data

(60) Provisional application No. 62/904,495, filed on Sep. 23, 2019.

(51) Int. Cl.
*G09F 7/18* (2006.01)
*G09F 7/10* (2006.01)

(52) U.S. Cl.
CPC ..... *G09F 7/18* (2013.01); *G09F 7/10* (2013.01); *G09F 2007/1873* (2013.01)

(58) Field of Classification Search
CPC ..... G09F 7/10; G09F 7/18; G09F 2007/1873; G09F 13/06; G09F 7/08; A47G 2001/0688; A47G 1/168; A47G 1/17
USPC ..... 40/124.08
See application file for complete search history.

(56) References Cited

U.S. PATENT DOCUMENTS 2,093,598 A * 9/1937 Clark ..... G09F 3/203 40/661.09
4,055,012 A * 10/1977 Cote ..... G09F 3/20 40/594
4,731,945 A * 3/1988 Howard ..... G09F 7/00 40/491
4,835,889 A * 6/1989 McClymonds ..... G09F 7/00 40/490
4,936,606 A * 6/1990 Moss ..... G09F 3/02 156/67
4,955,153 A * 9/1990 Albrecht ..... G09F 3/18 40/490
5,025,581 A * 6/1991 Polzin ..... G09F 3/203 40/594
5,161,343 A * 11/1992 Edwards ..... E06B 5/006 52/311.1
5,988,684 A * 11/1999 Blaustein ..... G09F 19/08 281/15.1
6,347,467 B1 * 2/2002 Meyer ..... A47G 1/0633 40/124.06
6,385,876 B1 * 5/2002 Mc Kenzie ..... B60R 13/10 40/201

(Continued)

*Primary Examiner* — David R Dunn
*Assistant Examiner* — Christopher E Veraa
(74) *Attorney, Agent, or Firm* — Wayne Edward Ramage; Baker Donelson

(57) ABSTRACT

A sign with the front comprising one or more image and/or text cut-outs. The cut-outs may be used in combination with non-cutout images or text, which are can be printed or otherwise fixed to the front. A sleeve or holder is disposed on the back of the sign to receive and secure one or more inserts. Inserts may then be inserted and removed through the top opening. Images, colors, or patterns on the side of the insert facing the front of the sign can be seen through the cut-outs by a viewer of the sign, and appear to fill the respective portions of the cut-outs. Inserts may be changed out periodically to change the appearance of the sign without changing the cut-out images and/or text. Inserts may be changed out daily, seasonally, for holidays, and for special events or other reasons.

13 Claims, 30 Drawing Sheets

(56) References Cited

U.S. PATENT DOCUMENTS

| | | | | |
|---|---|---|---|---|
| 6,886,282 | B2 * | 5/2005 | Sumner, III | G09F 21/048 40/650 |
| 8,172,270 | B2 * | 5/2012 | Rossing | A45C 13/42 283/80 |
| 8,956,000 | B2 * | 2/2015 | Martinez | F21V 33/006 362/151 |
| 2004/0123503 | A1 * | 7/2004 | Pitzen | G09F 3/20 40/594 |
| 2006/0026879 | A1 * | 2/2006 | Tebaldi | G09F 3/10 40/310 |
| 2006/0059747 | A1 * | 3/2006 | Wescott | G09F 7/12 40/594 |
| 2007/0124974 | A1 * | 6/2007 | Lanier | G09F 3/204 40/658 |
| 2009/0211137 | A1 * | 8/2009 | Trantham | G09F 3/20 40/654.01 |
| 2011/0239511 | A1 * | 10/2011 | Wisniewski | A47G 1/0616 40/711 |
| 2013/0326922 | A1 * | 12/2013 | Lyons | G09F 7/08 40/611.01 |
| 2015/0181677 | A1 * | 6/2015 | Martinez | F21V 21/08 362/145 |
| 2016/0192791 | A1 * | 7/2016 | Gao | A47G 1/0616 40/714 |
| 2020/0359812 | A1 * | 11/2020 | Clores | A47G 1/06 |

* cited by examiner

SIGN WITH INSERTS

This application claims benefit of and priority to U.S. Provisional App. No. 62/904,495, filed Sep. 23, 2019, which is incorporated herein by specific reference for all purposes.

FIELD OF INVENTION

This invention relates to a sign with cut-out or transparent images and/or text with a sleeve for holding inserts to alter the background appearance within the cut-outs.

SUMMARY OF INVENTION

This invention relates to ap sign with the front comprising one or more image and/or text cut-outs. The cut-outs may be used in combination with non-cutout images or text, which are can be printed or otherwise fixed to the front. A sleeve or holder is disposed on the back of the sign to receive and secure one or more inserts. Inserts may then be inserted and removed through the top opening. Images, colors, or patterns on the side of the insert facing the front of the sign can be seen through the cut-outs by a viewer of the sign, and appear to fill the respective portions of the cut-outs. Inserts may be changed out periodically to change the appearance of the sign without changing the cut-out images and/or text. Inserts may be changed out daily, seasonally, for holidays, and for special events or other reasons.

DETAILED DESCRIPTION OF EXEMPLARY EMBODIMENTS

Figure 1:
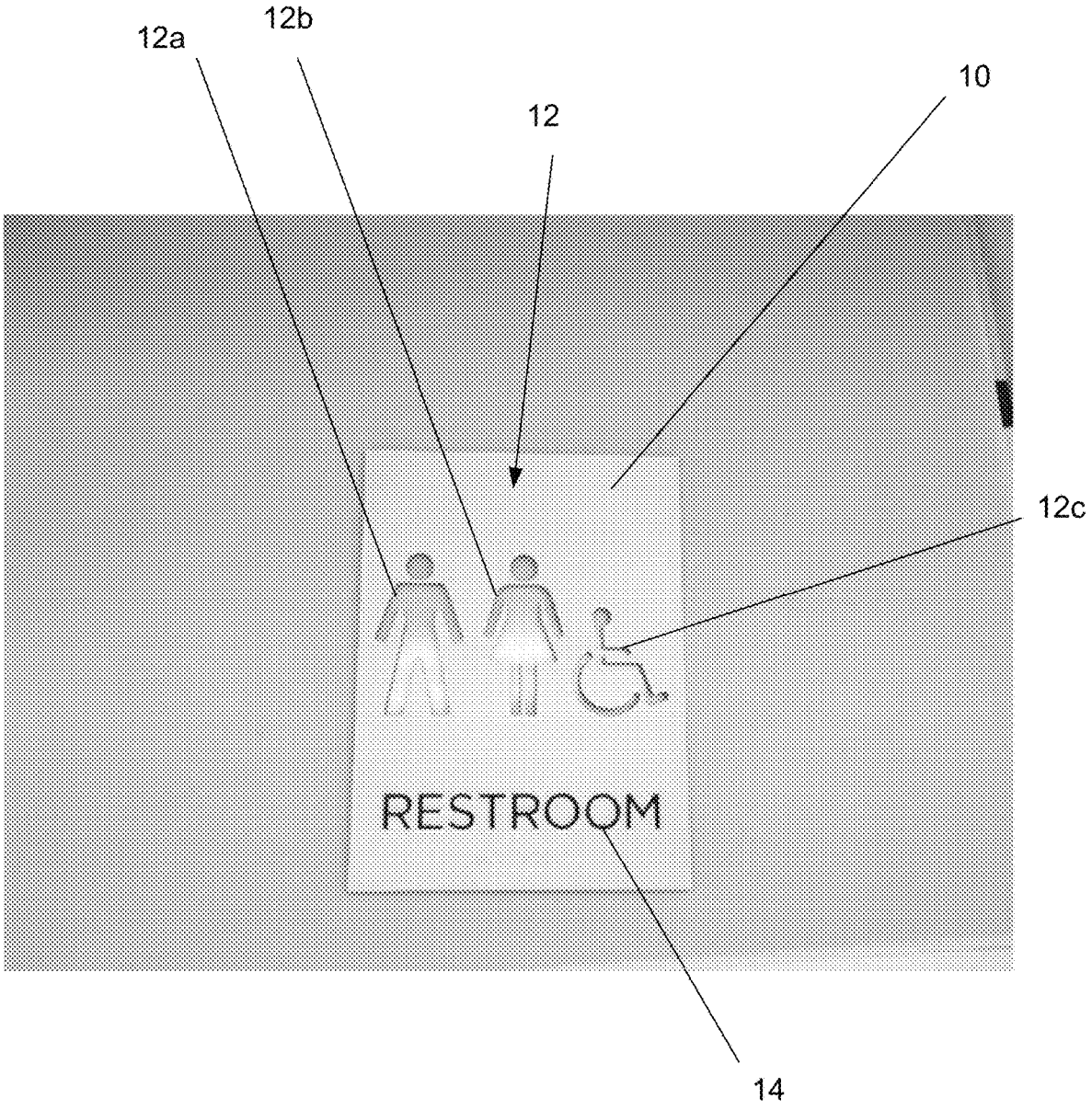
FIG. 1 shows an example of a sign with cut-out images and fixed text with no insert.
Figure 2:
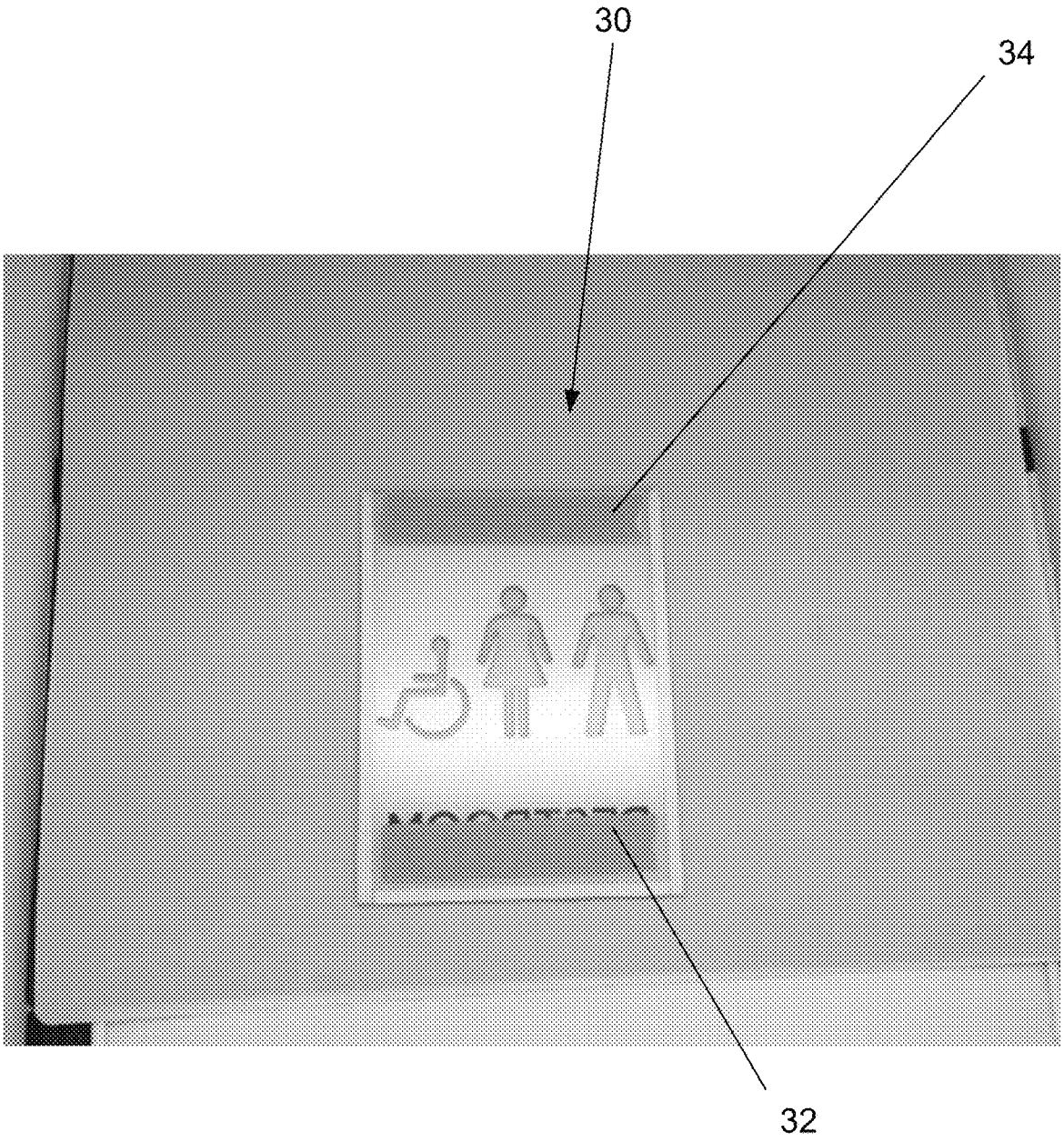
FIG. 2 shows a back view of the sign of FIG. 1 with a two-part sleeve.

In various exemplary embodiments, as seen in FIGS. 1-30, the present invention comprises a sign 10 with a front and a back, with the front comprising one or more images and/or text cut-outs 12 extending through the front, The cut-outs may be used in combination with non-cutout images or text 14, which are can be printed or otherwise fixed to the front. FIG. 1, for example, shows a restroom sign with fixed and raised non-cutout text 14, with three cut-out images (i.e., man 12*a*, woman 12*b*, wheelchair 12*c*). Cut-outs images may be of any size or shape, including but not limited to circles, ovals, square, rectangles, hexagons, pentagons, octagons, other polygonal shapes, letters, numbers, words or phrases, humans, animals, trees, plants, furniture, machinery, or any form of image or design. The sign may be made of any suitable material known in the art: e.g., wood, plastic, acrylic, metal, paper, or other similar material. As described below, one or more inserts 20 are positioned behind the cut-outs and are visible therethrough.

In several embodiments, in place of or in addition to cut-out areas, the front of the sign may comprise one or more areas that are transparent 16, so that the inserts 20 may be visible therethrough, as described below. Other portions of the sign 10 may be colored or solid, with or without one or more fixed images or text (e.g., a room number 14*a*). A sign may comprise a combination of both cut-out areas, transparent areas, or transparent windows across some or all cut-out areas.

A sleeve or holder 30, or similar holding means, is disposed on the back of the sign to receive and secure one or more inserts. The sleeve or holder is open along the top and/or either side to allow the introduction and removal of inserts behind the sign. The sleeve/holder and inserts may be made of any suitable material, including, but not limited to, paper, tape with backer, cardboard, cellophane, plastic, acrylic, or the like. A single sleeve or holder may be provided on one sign, or multiple sleeves or holders may be provided on a sign. Accordingly, a single sleeve or holder may be used to provide an insert for a single cut-out or transparent window, or multiple cut-outs or transparent windows. Similarly, multiple sleeves or holders may be used to provide inserts for multiple cut-outs or transparent windows, and multiple sleeves or holders may be used to provide multiple inserts for a single cut-out or transparent window.

Figure 3:
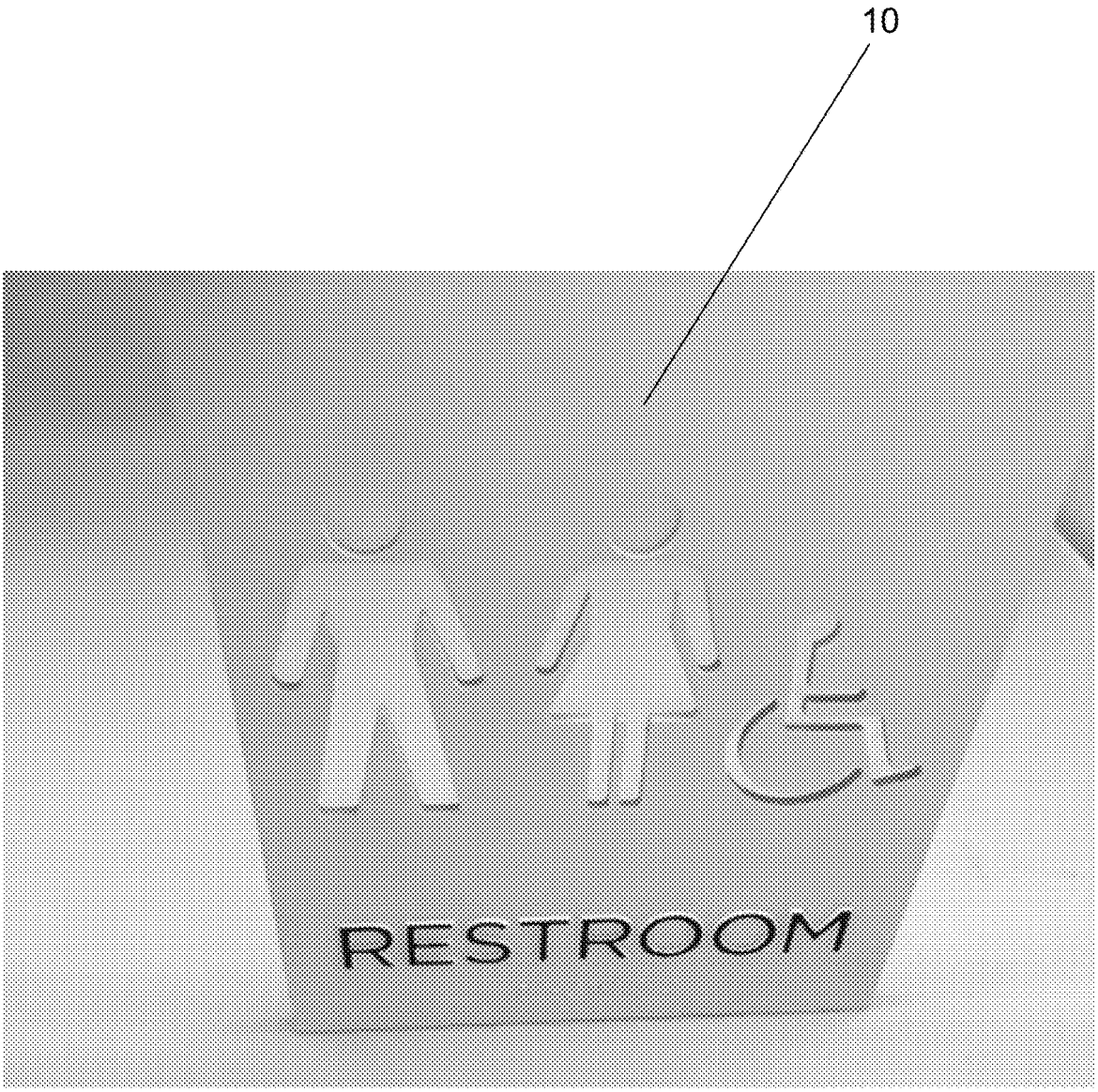
FIG. 3 shows a perspective front view of the sign of FIG. 1.
Figure 4:
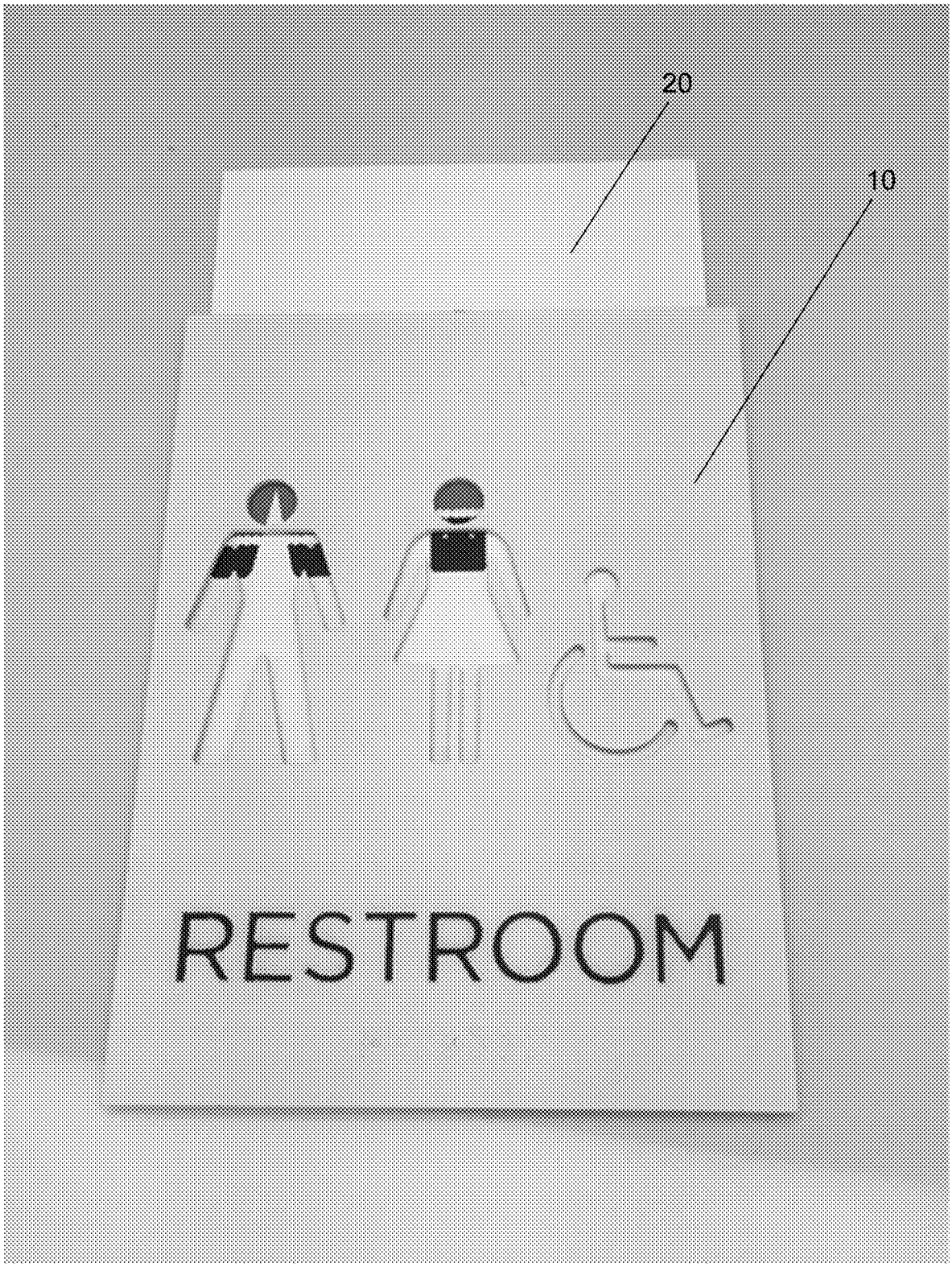
FIG. 4 shows a view of an insert being inserted into the sleeve on a sign.
Figure 5:
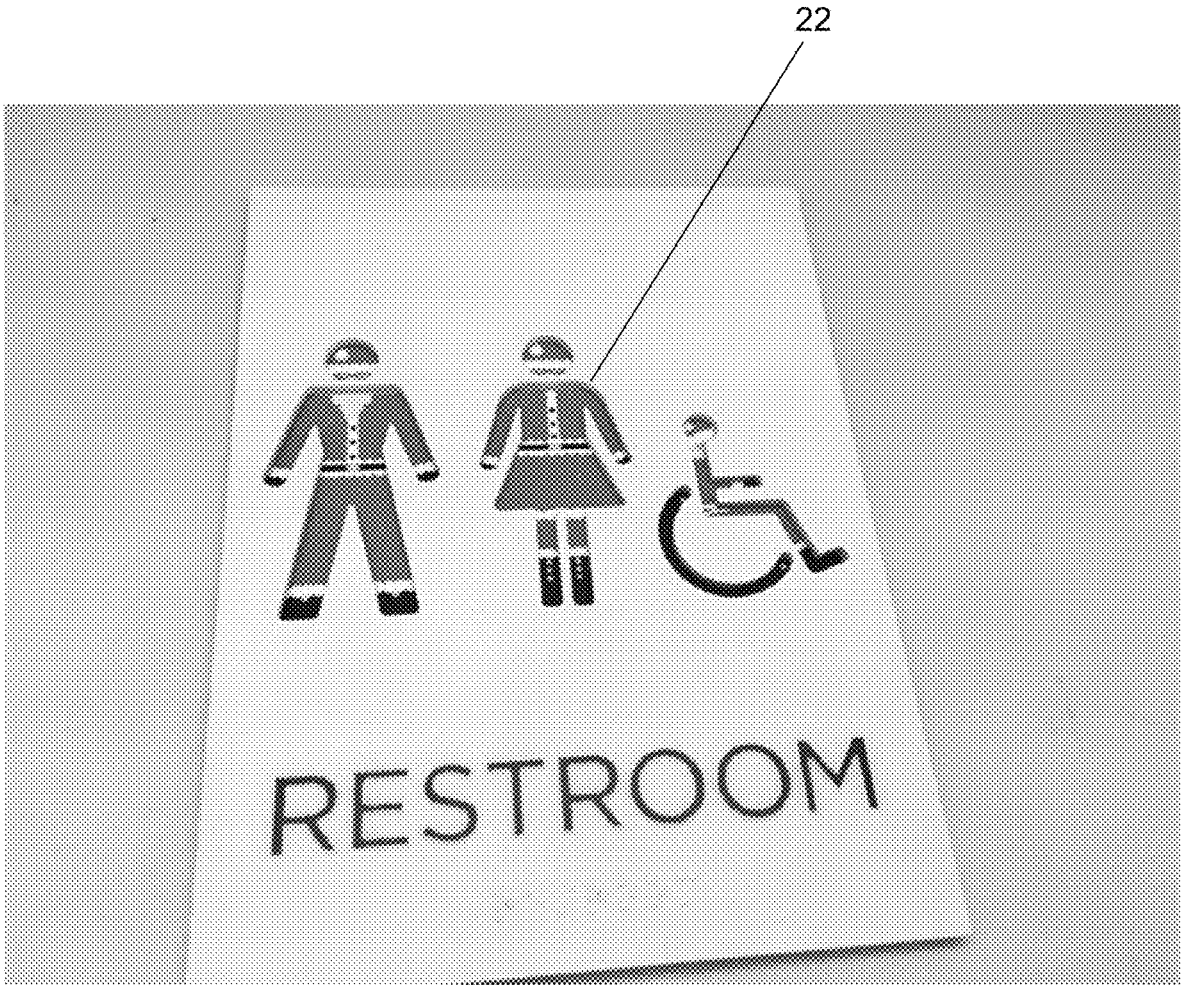
FIGS. 5-10 show front views of the sign of FIG. 1 with various inserts.
Figure 6:
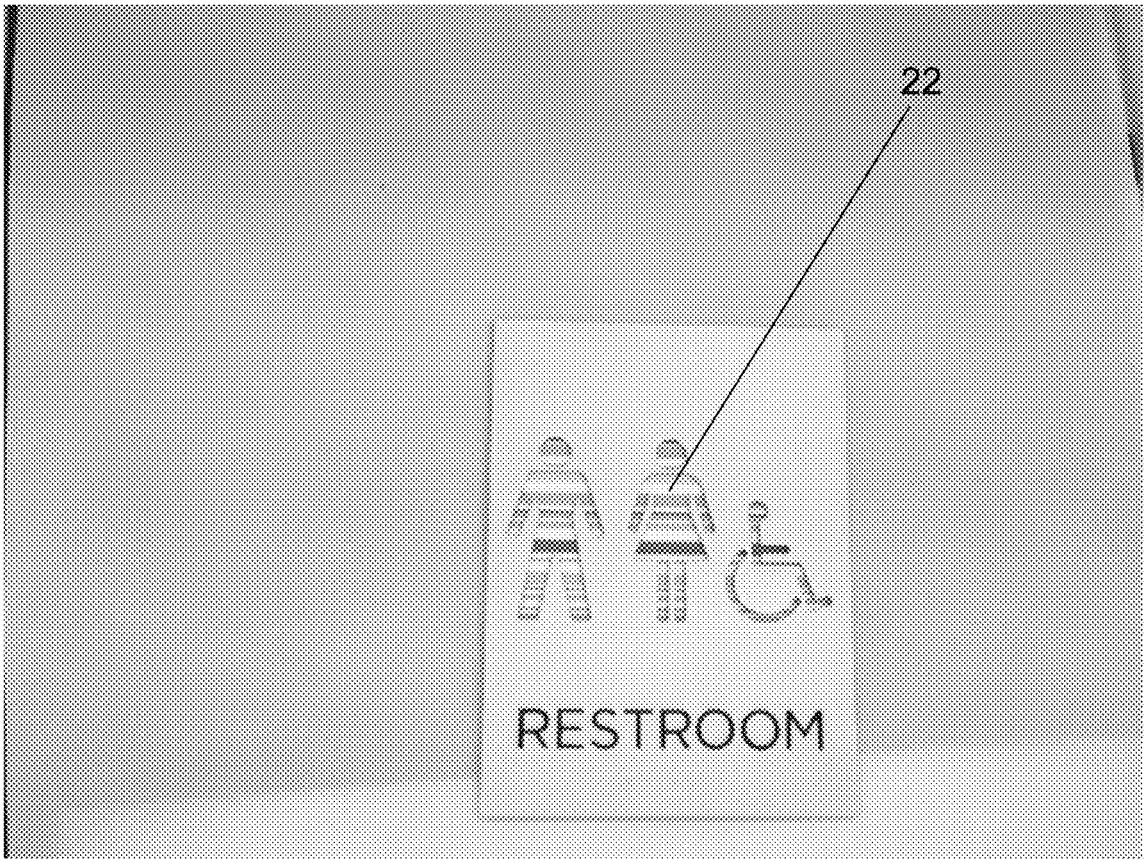
Figure 7:
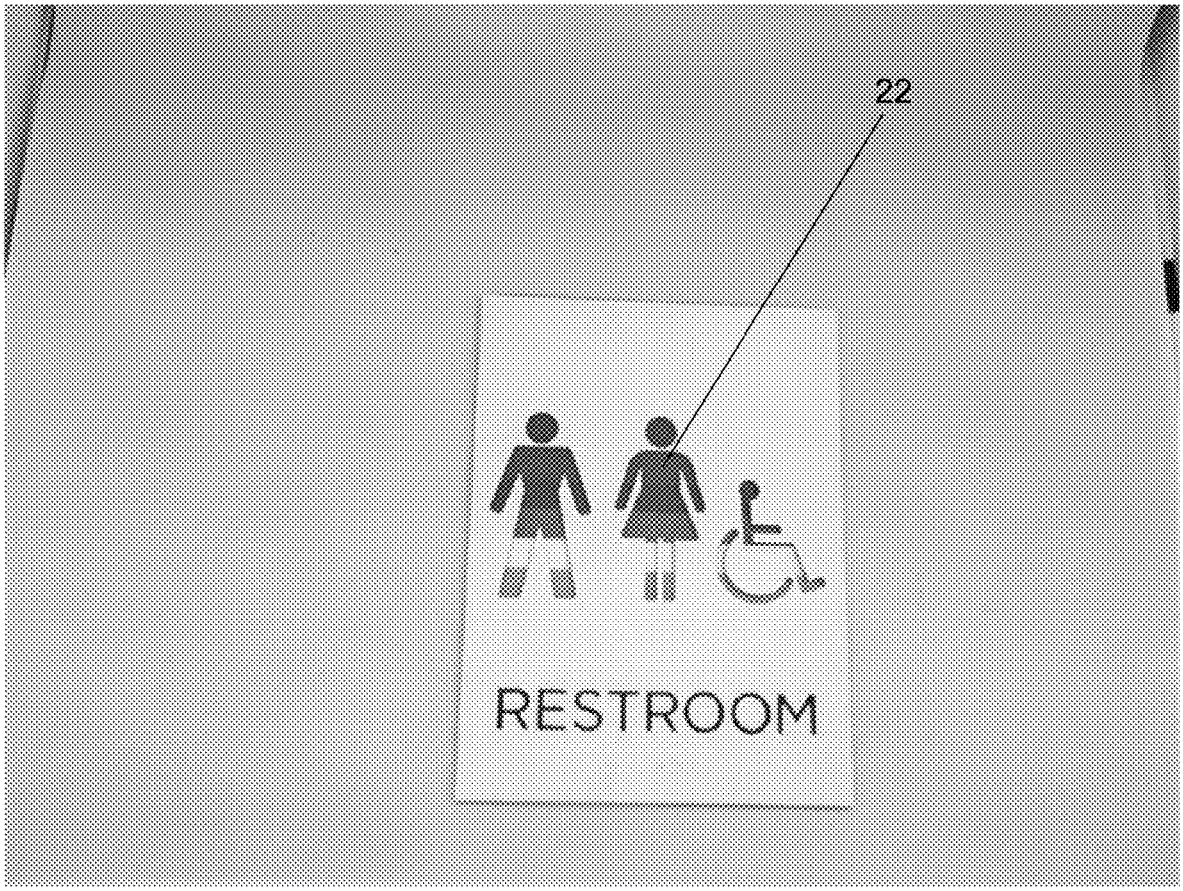

The sleeve or holder 30 may comprise a single flat panel extending from the bottom of the sign upwards for some or all of the sign, with an opening at the top. Inserts may then be inserted and removed through the top opening. In an alternative embodiment, the sleeve or holder may comprise multiple parts or components, such as a base holder affixed to the bottom of the back of the sign, with tabs or holders extending up along the sides of the back of the sign. In the embodiment shown in FIG. 2, the sleeve or holder on the back of the sign 10 comprises a base holder 32 with an upper holder 34, which extends between each side (or proximate to each side) of the sign and has an open top and bottom to allow the insert to pass through. One or more inserts (additional inserts may be placed behind the viewable insert as a storage location for easy changes) are inserted through the opening. FIG. 3 shows an insert 20 that has been partially inserted. For removal, the insert 20 can be pushed upward and/or outward by pressure on the insert from any bottom openings or through the cut-out figures, or by pulling or lifting from the top. The sleeve or holder 30 may be formed as a single piece with the sign 10, or may be separately and removably affixed to the sign.

Images, colors, or patterns on the side of the insert facing the front of the sign can be seen through the cut-outs by a viewer of the sign, and appear to fill 22 the respective portions of the cut-outs. Inserts may be changed out periodically to change the appearance of the sign without changing the cut-out images and/or text. Thus, inserts may be changed out daily, seasonally, for holidays (e.g., Christmas, Thanksgiving, Halloween, and so on), for special events or other reasons (e.g., matching company colors or branding), or to indicate a particular mood or feeling.

Figure 8:
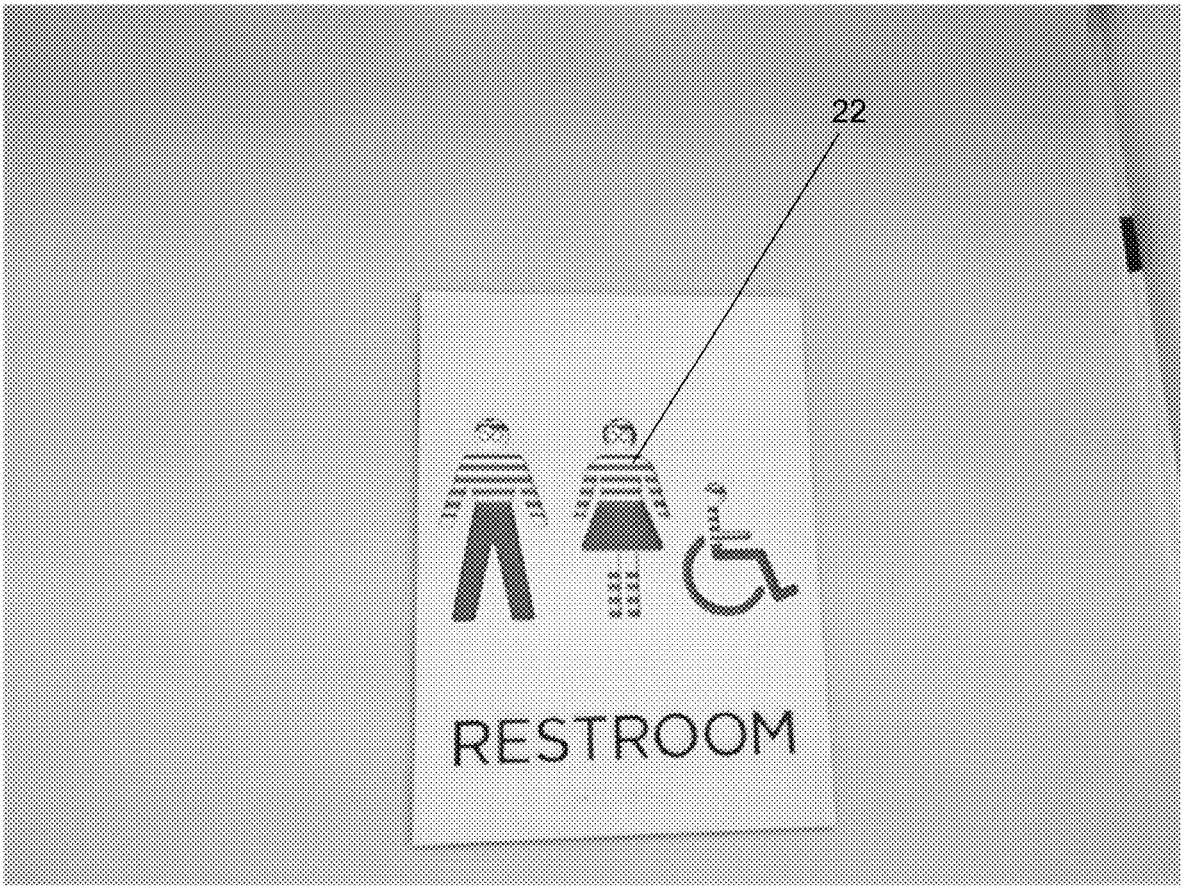
Figure 9:
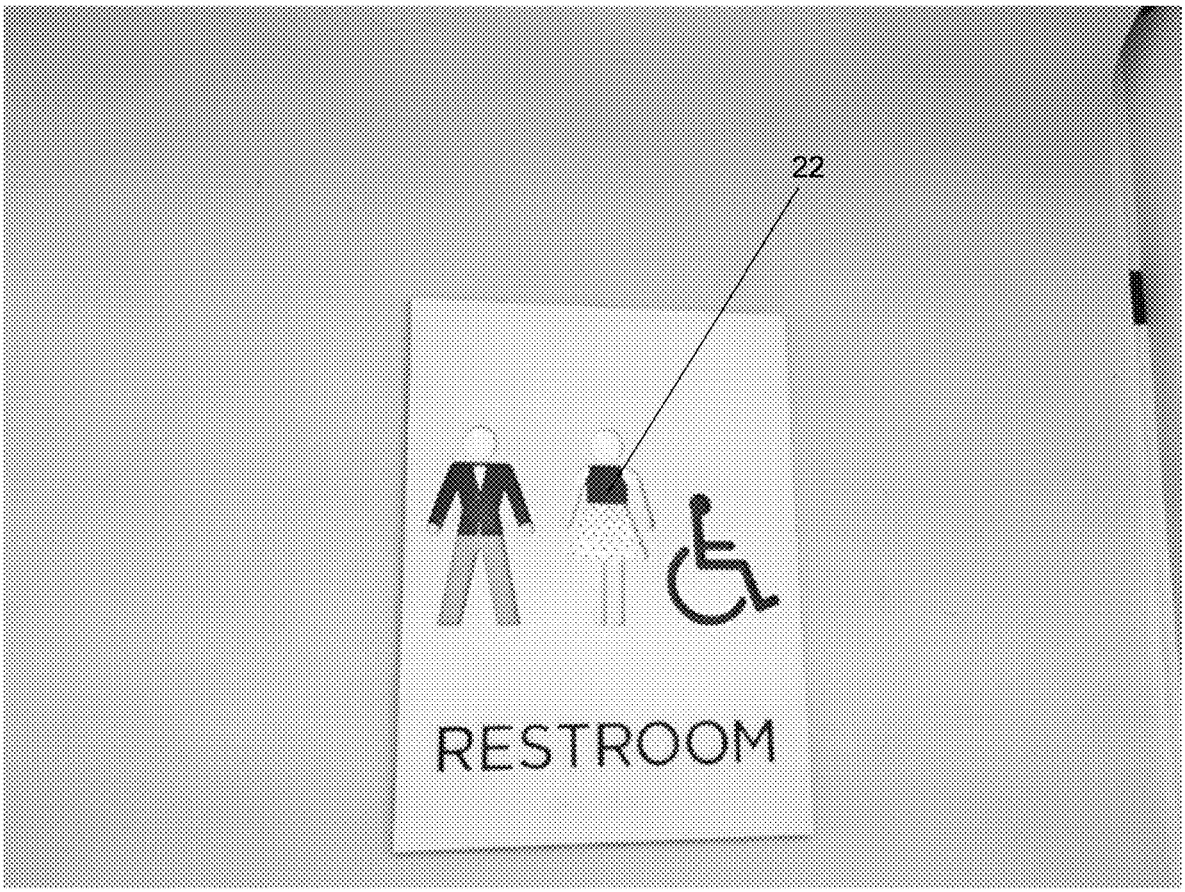
Figure 10:
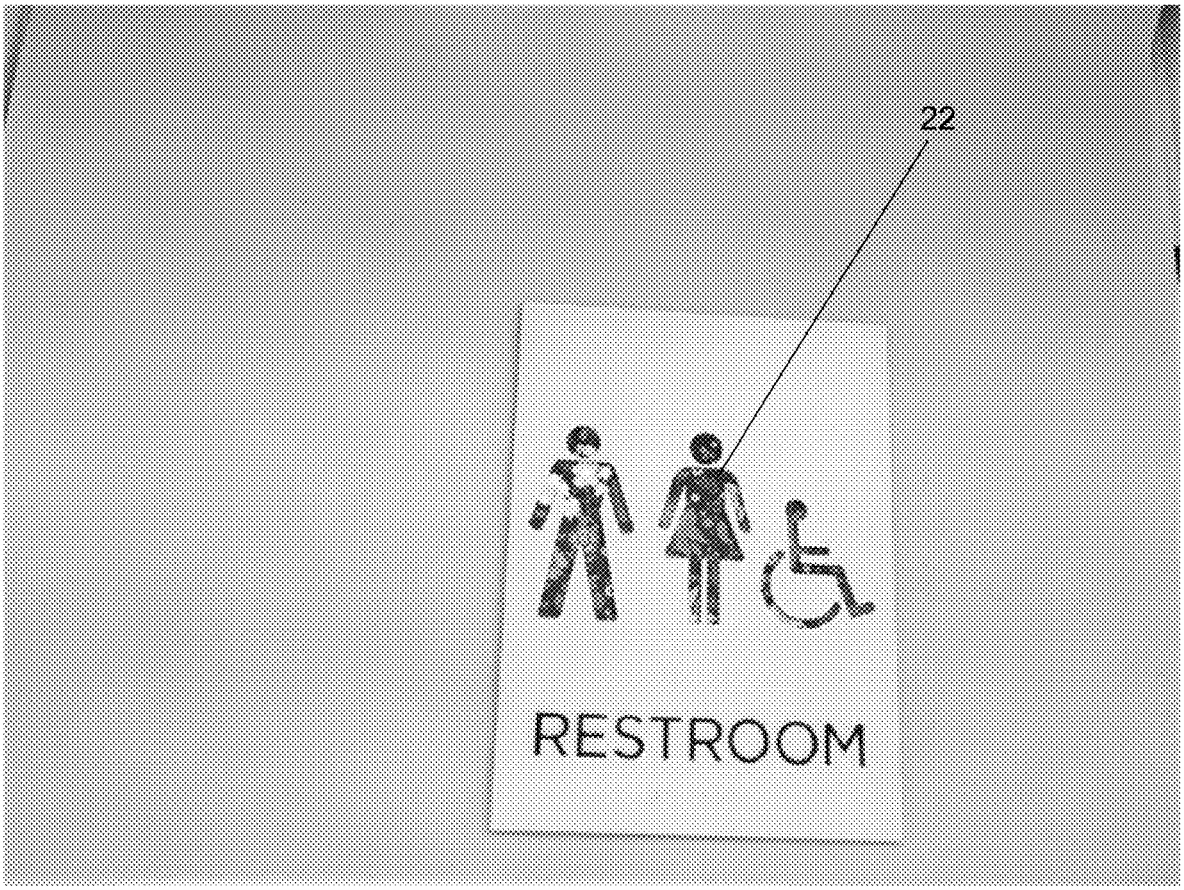
Figure 11:
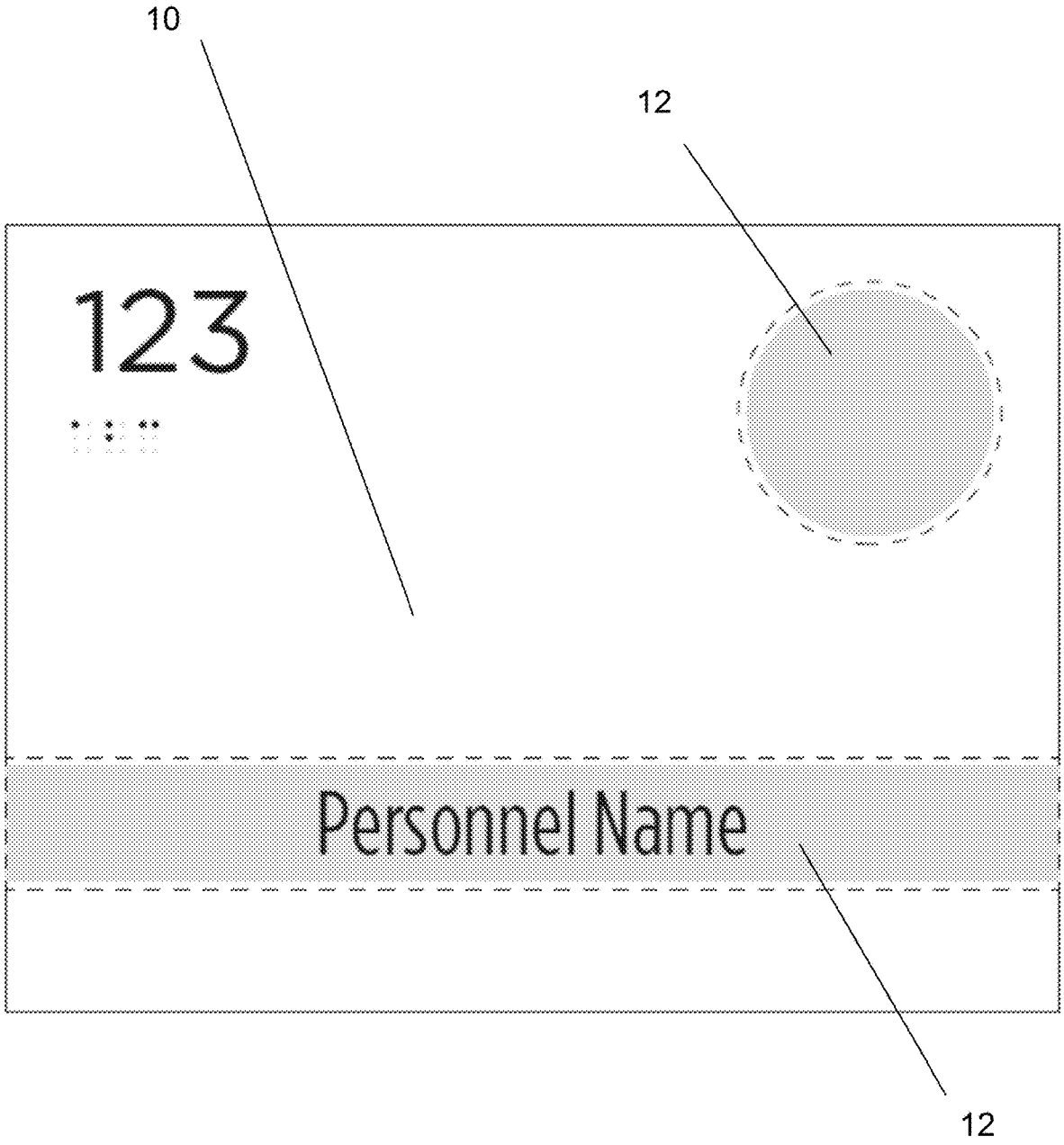
FIG. 11 shows an example of another embodiment of a sign with two transparent and/or cut-out areas.
Figure 12:
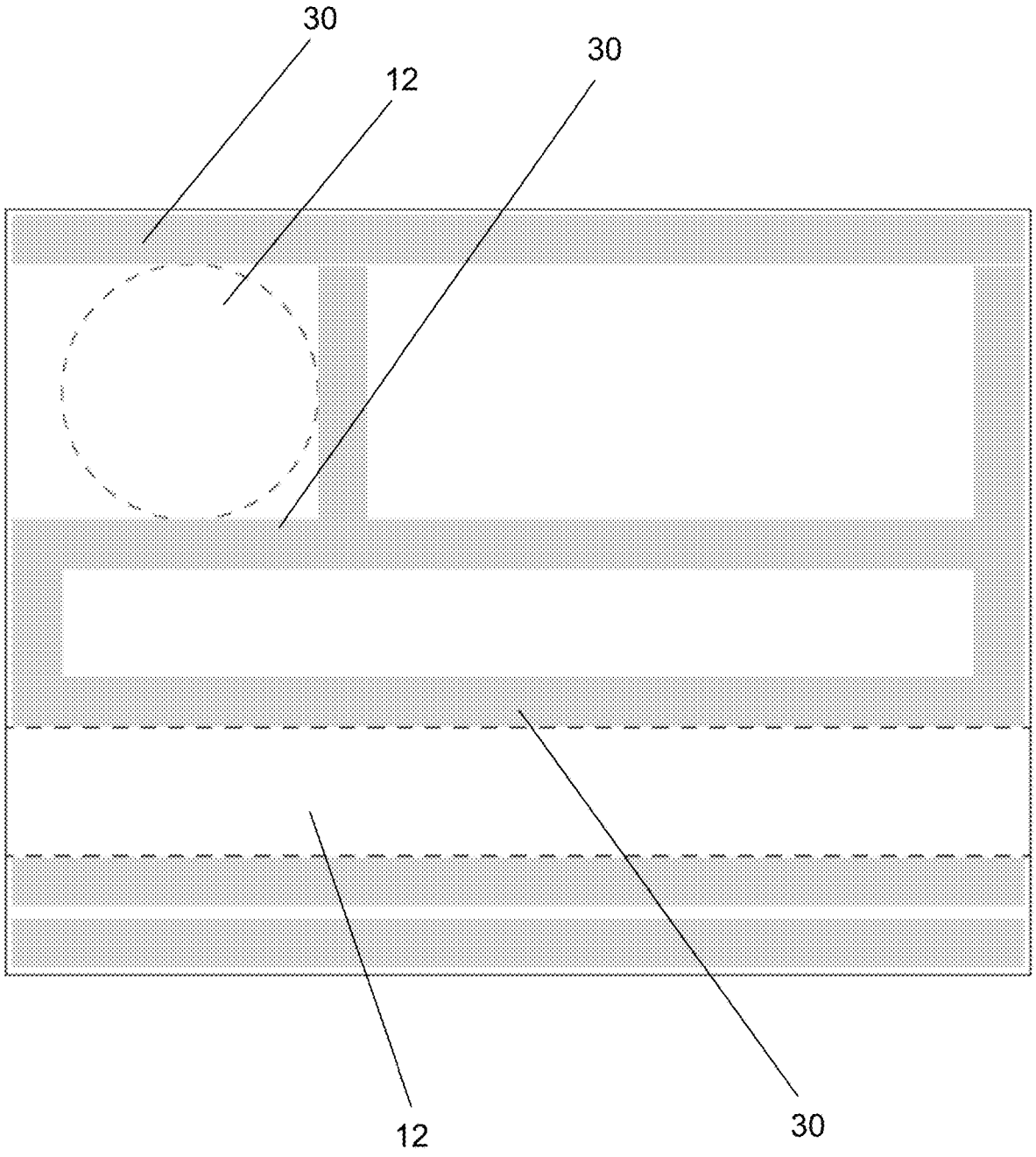
FIGS. 12-13 shows back views of the sign of FIG. 11 with multiple holders.
Figure 13:
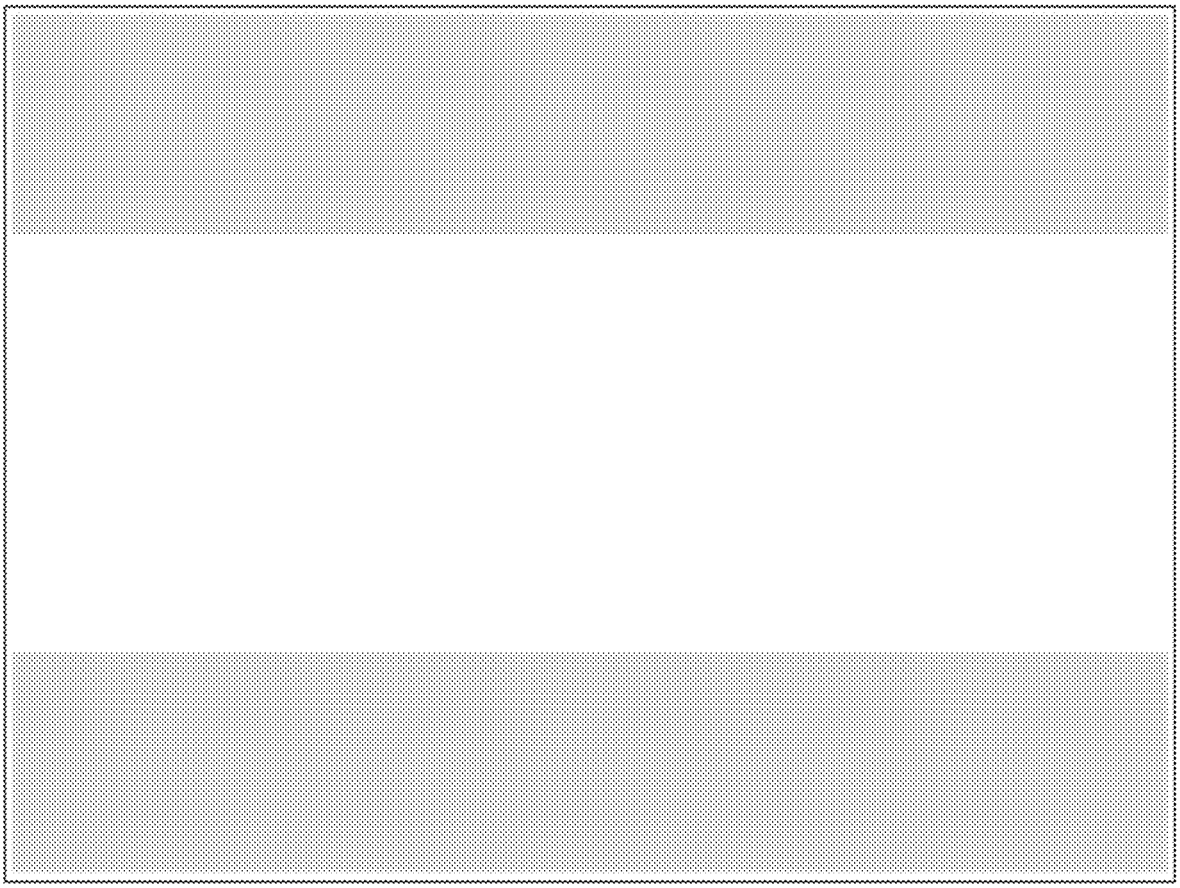
Figure 14:
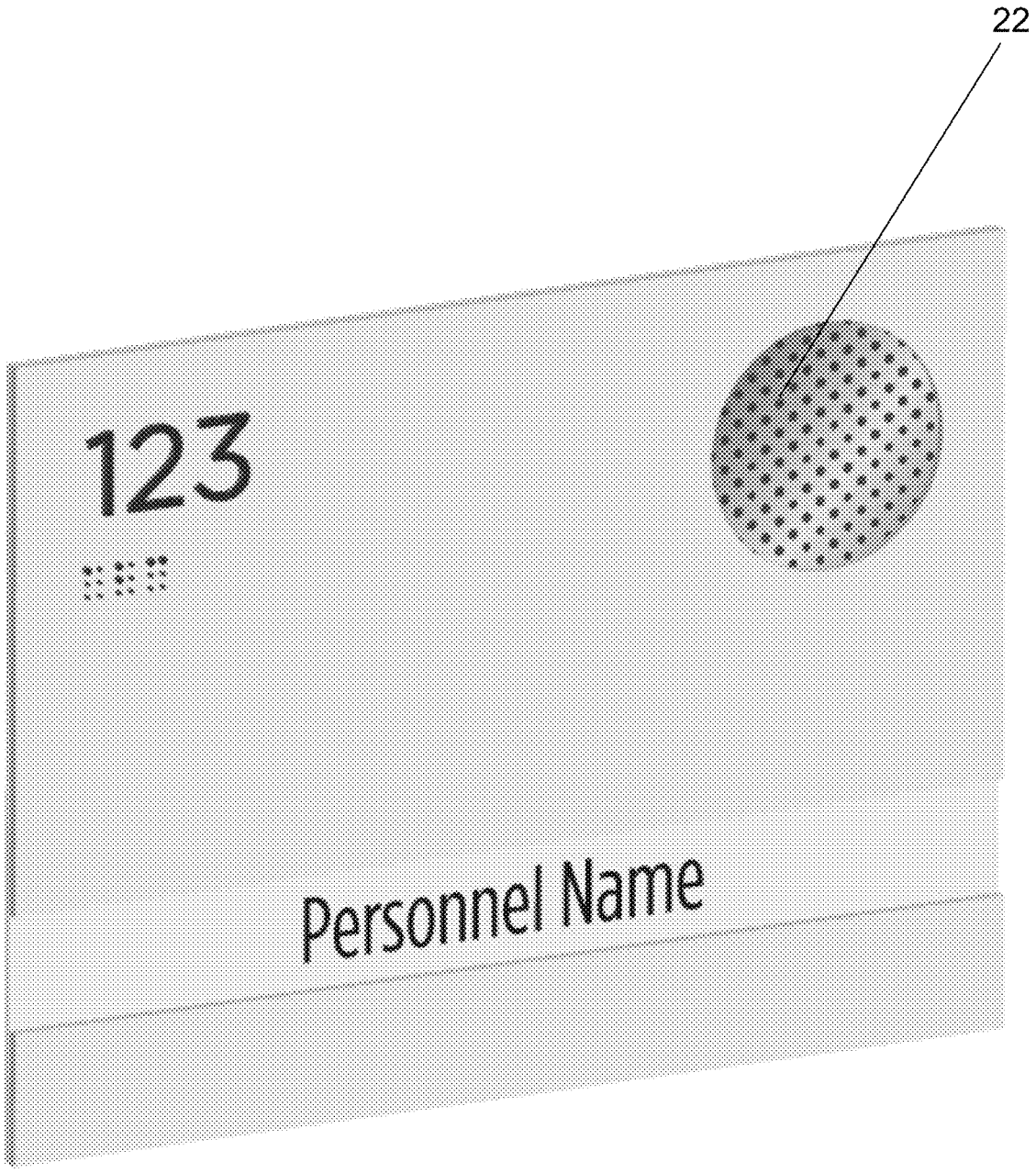
FIGS. 14-20 show front views of the sign of FIG. 11 with various inserts.
Figure 15:
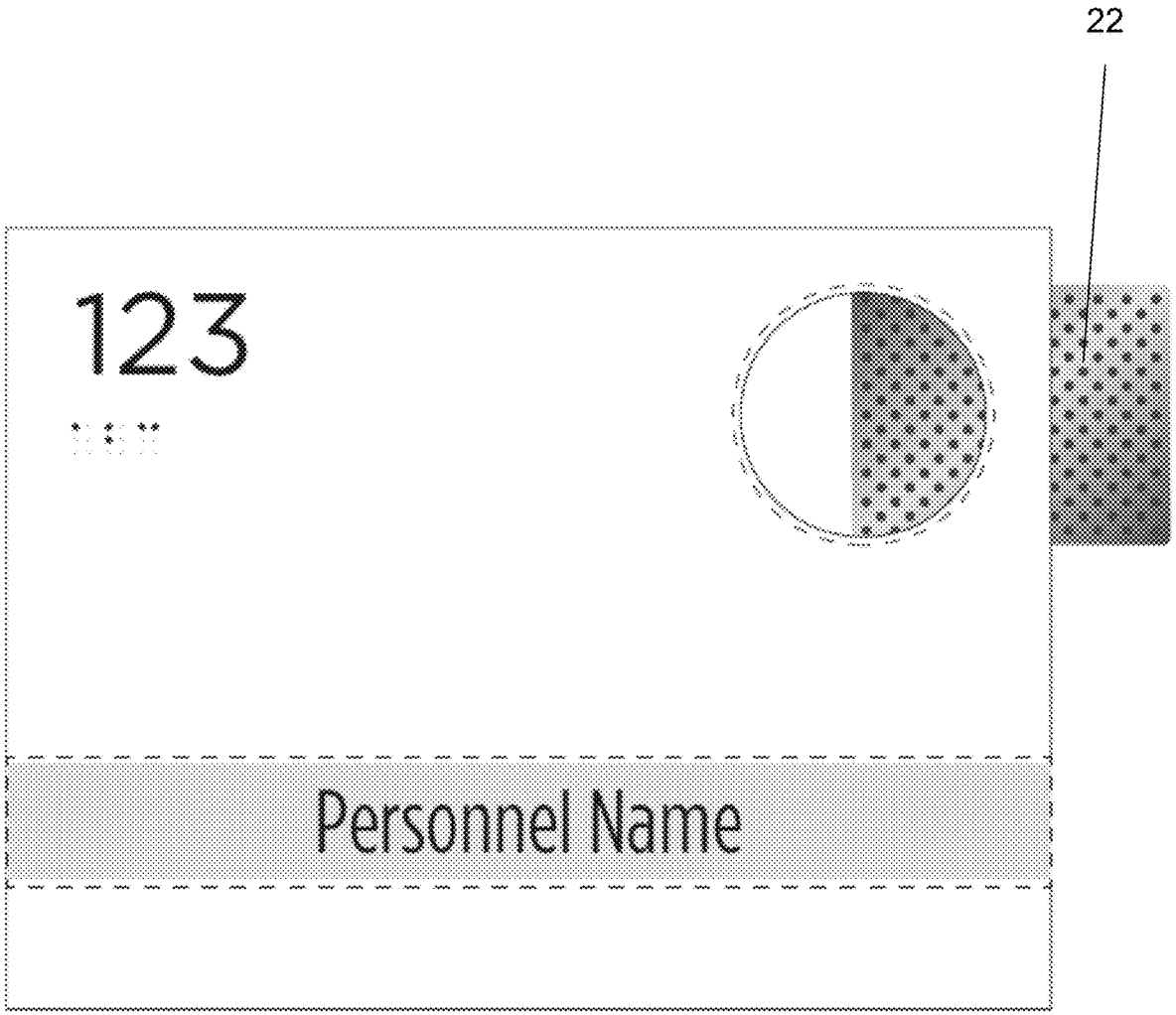
Figure 16:
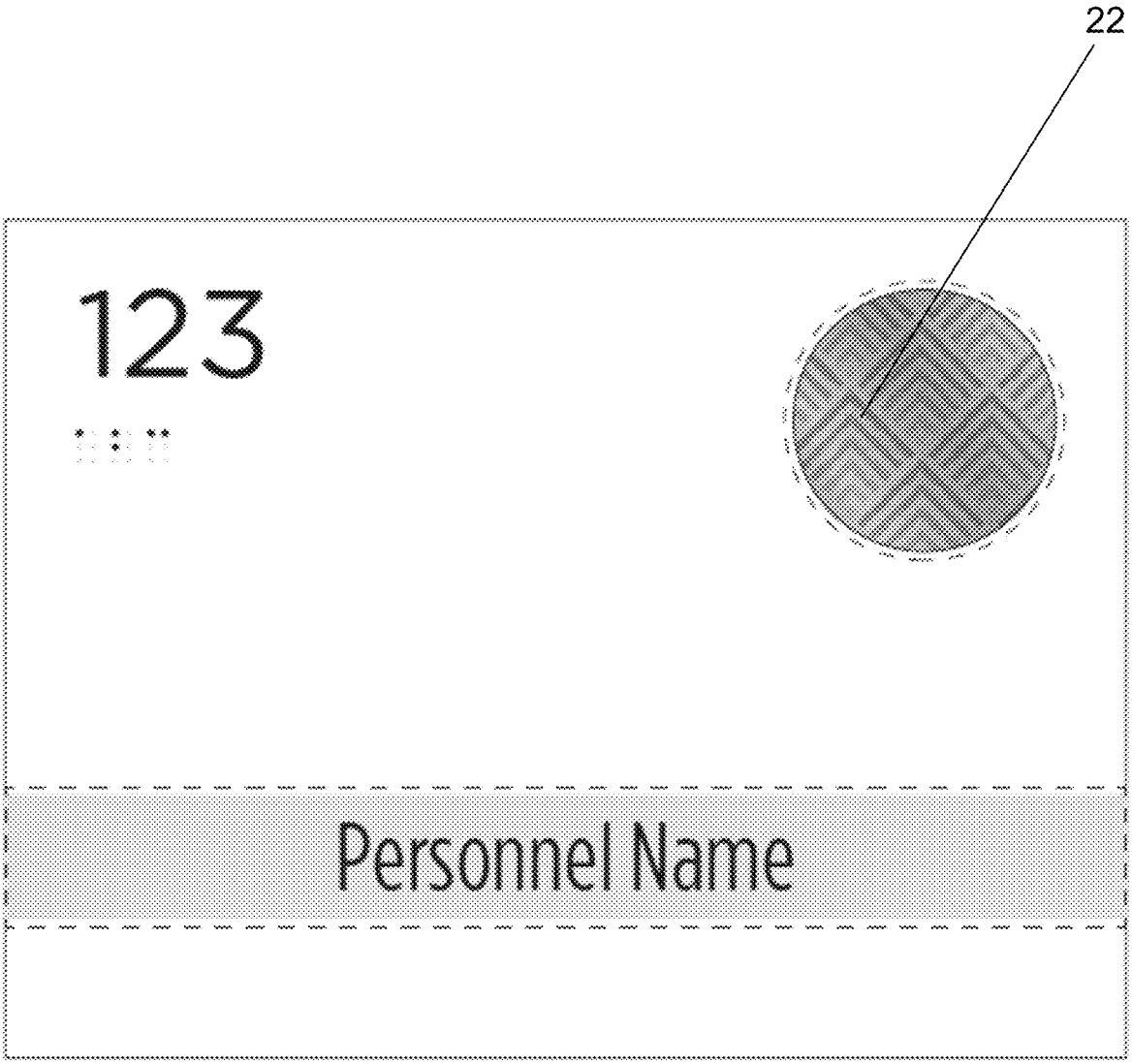
Figure 17:
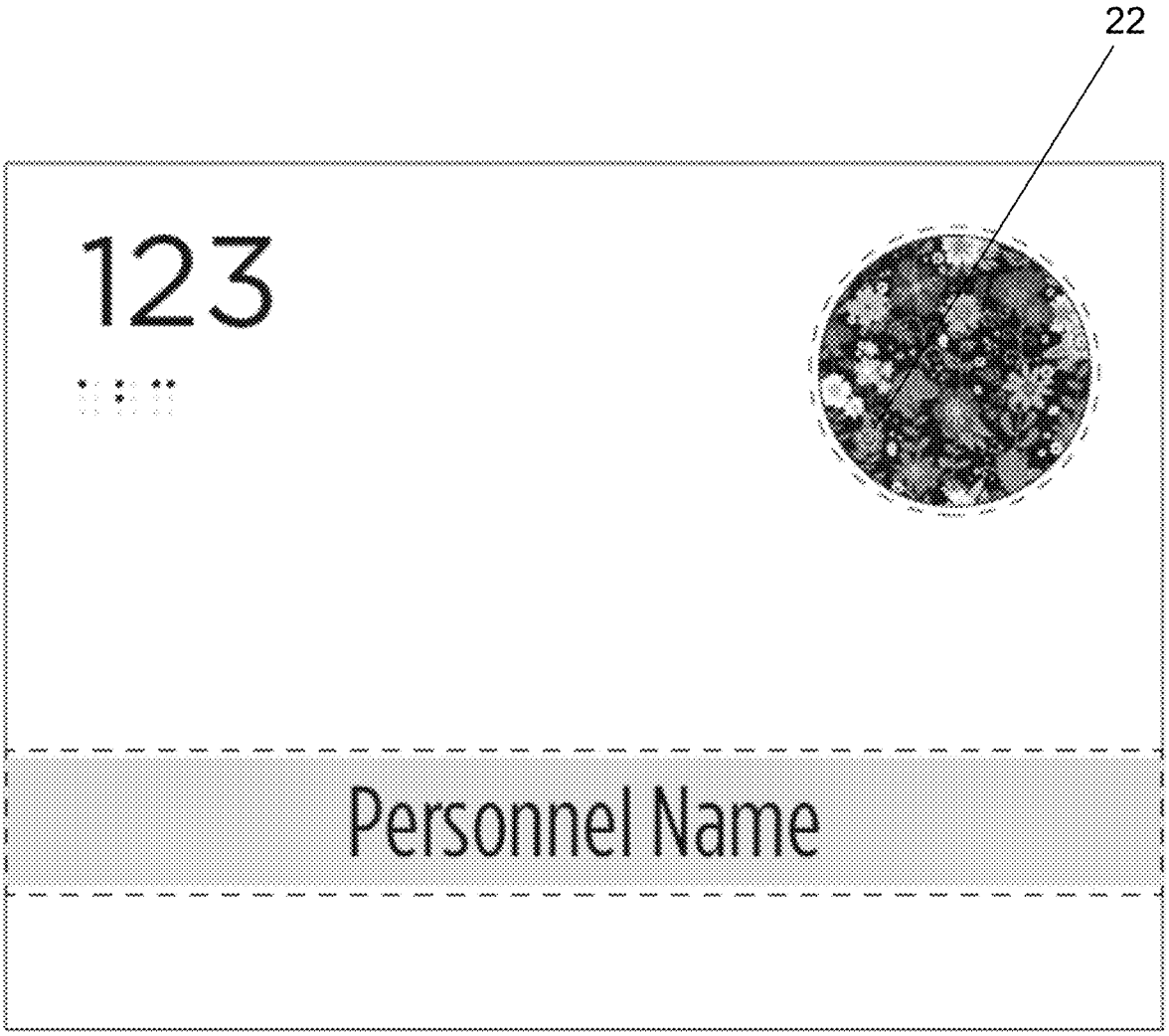
Figure 18:
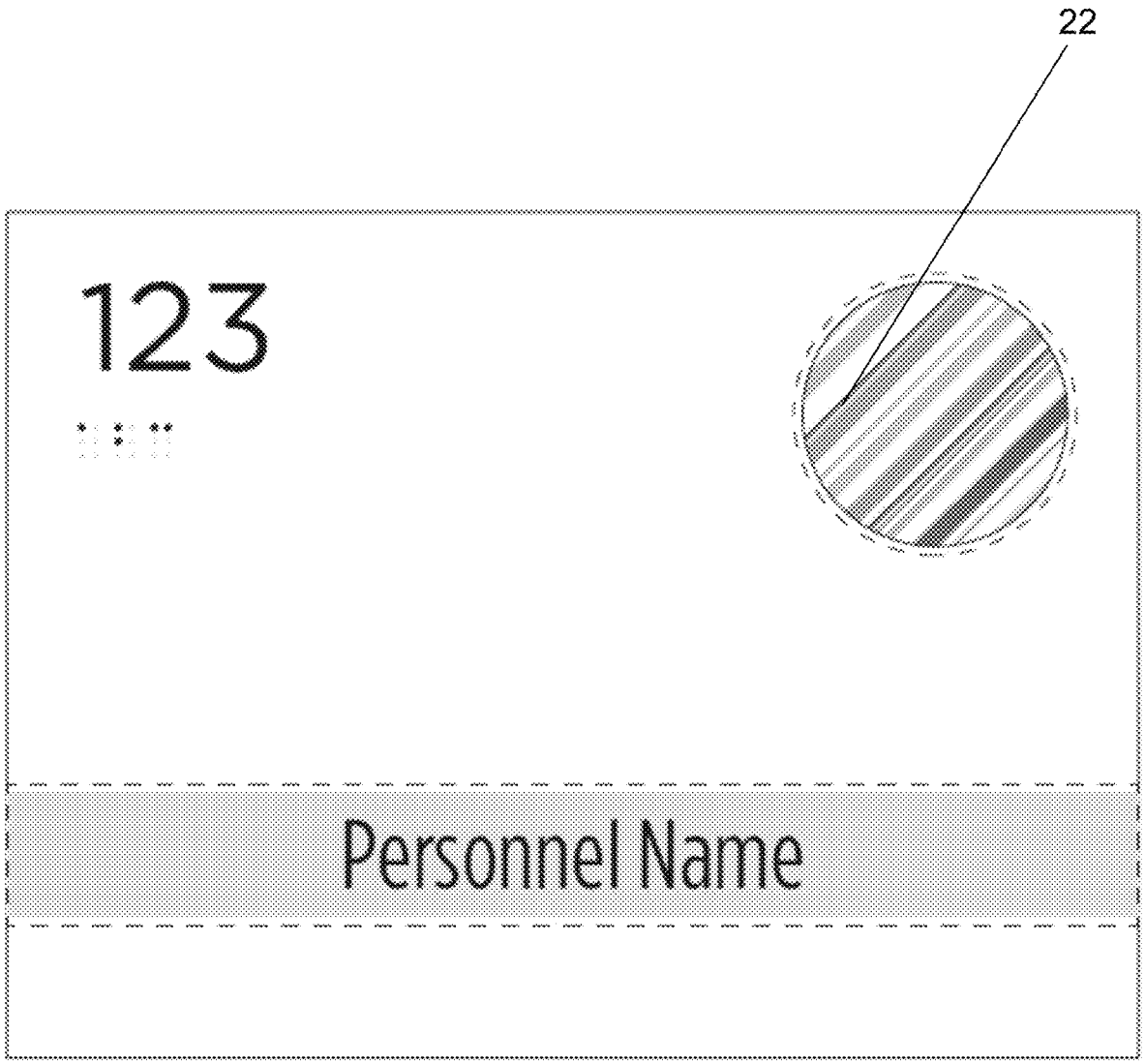
Figure 19:
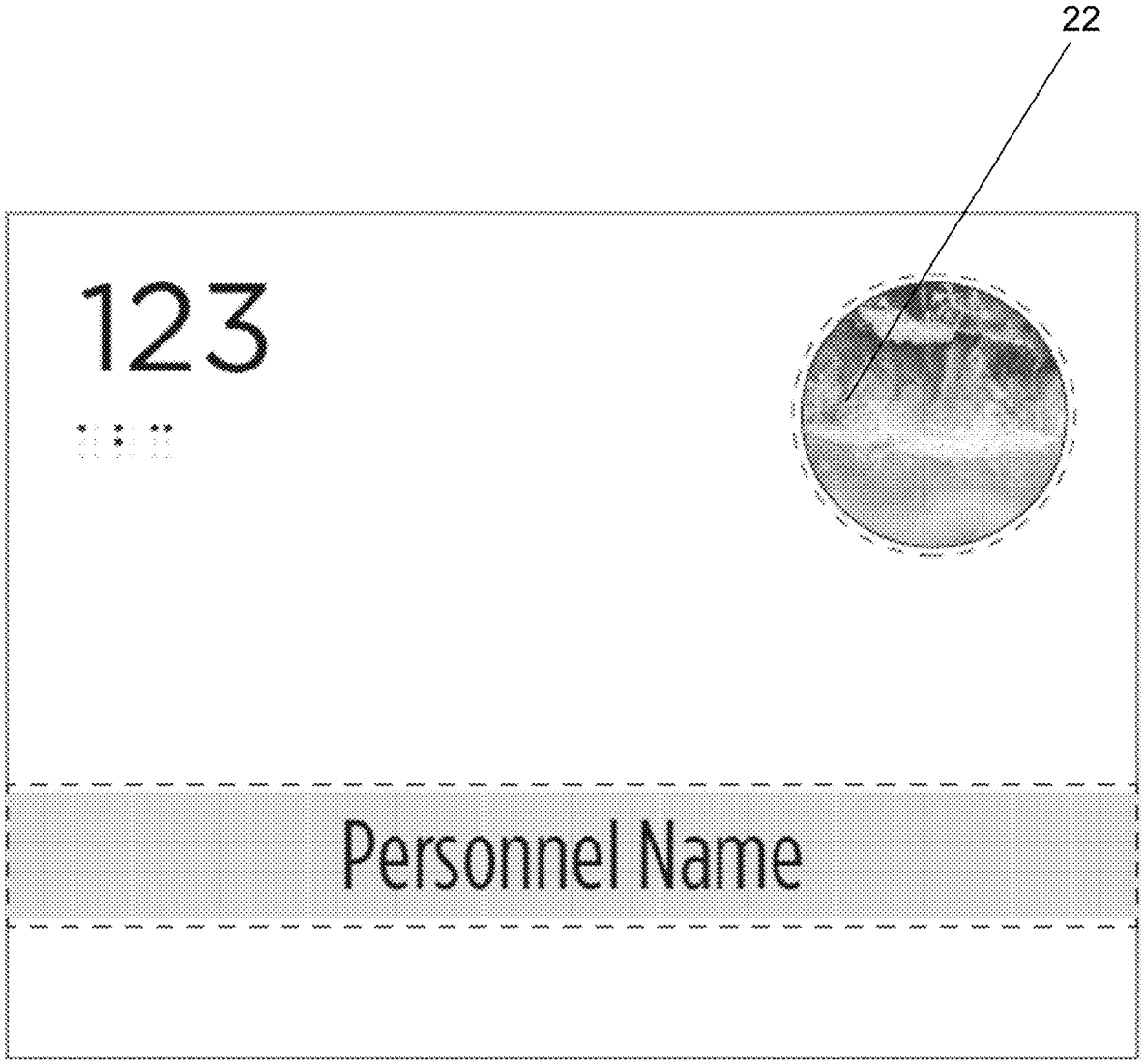
Figure 20:
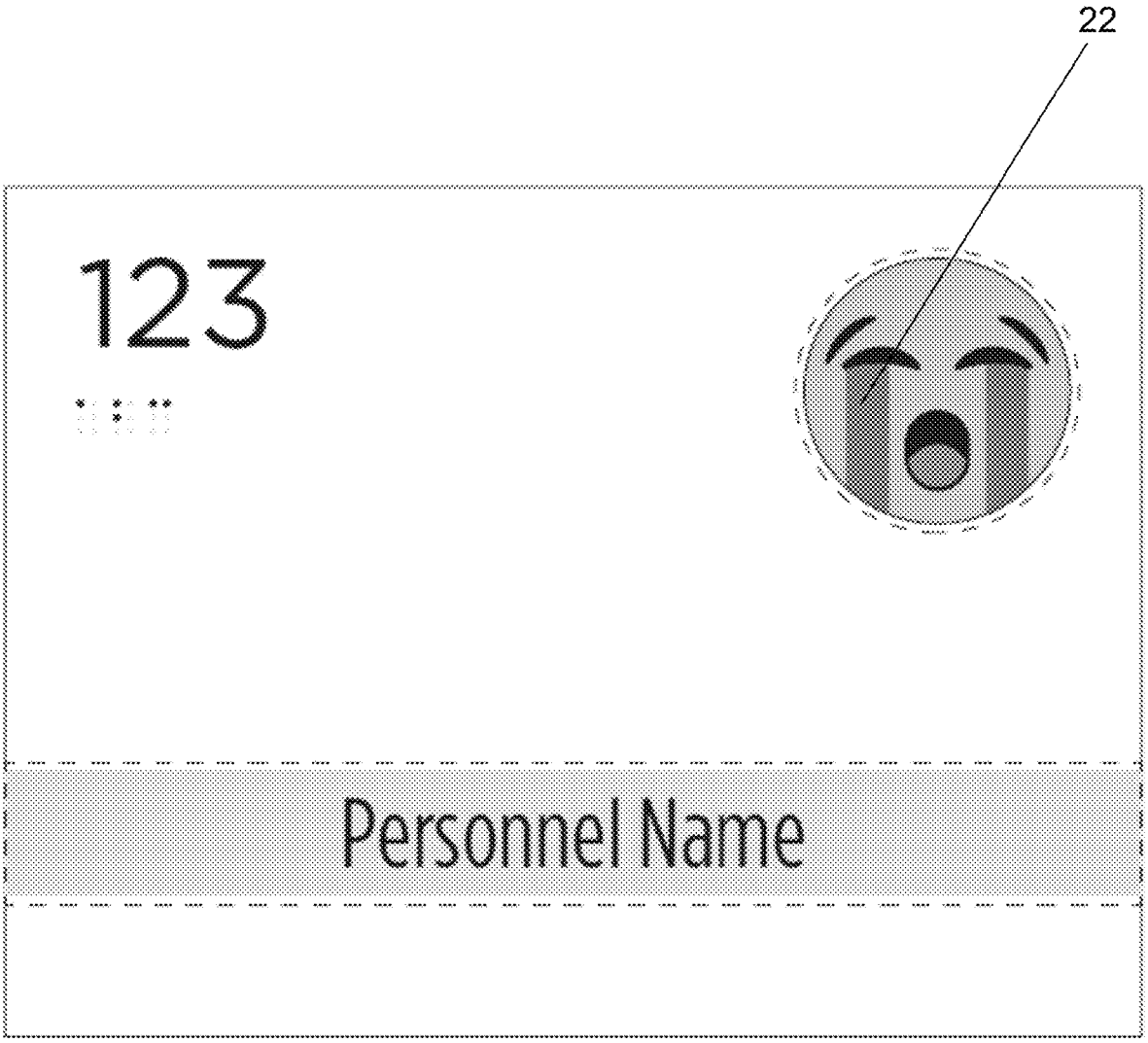
Figure 21:
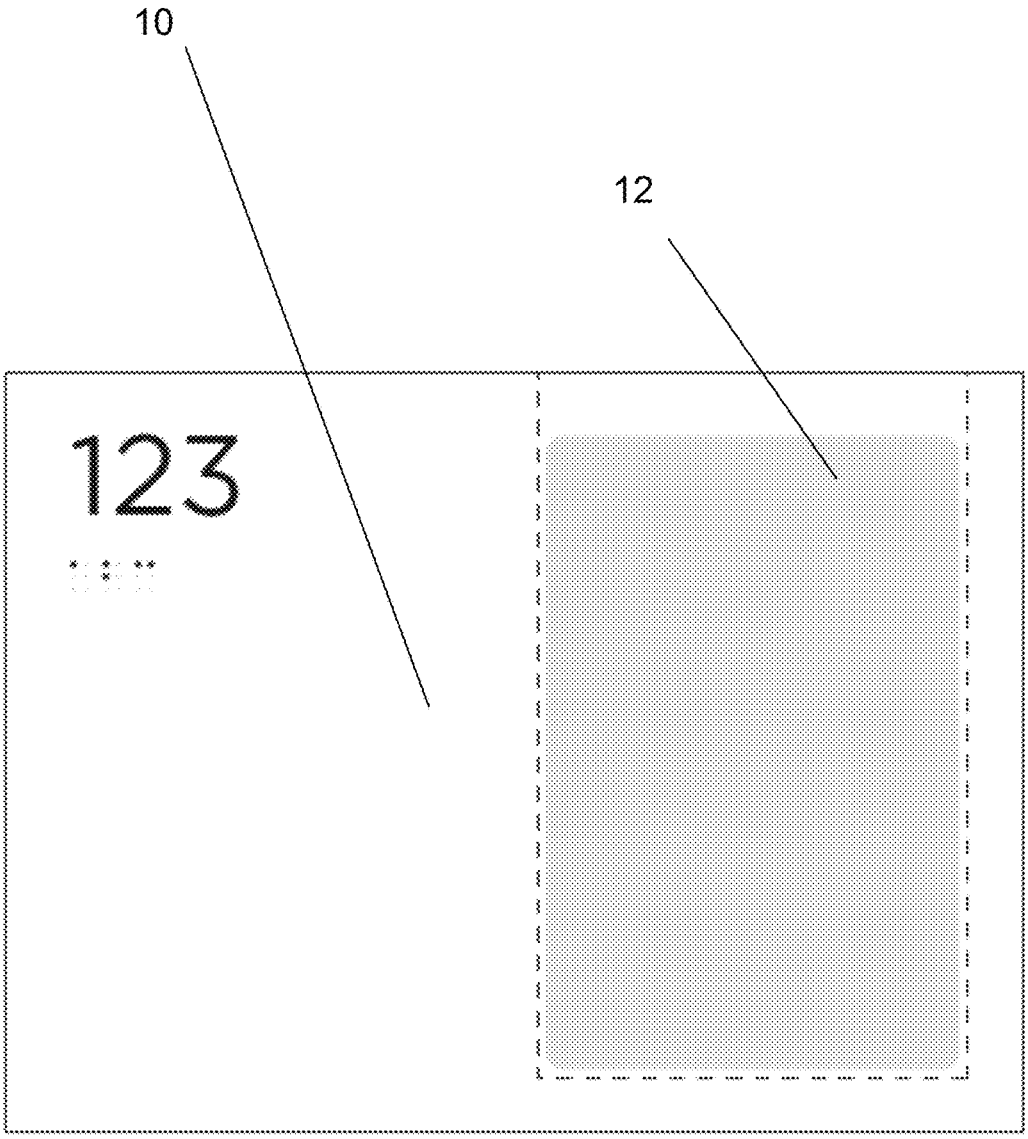
FIG. 21 shows an example of another embodiment of a sign with two transparent and/or cut-out areas.
Figure 22:
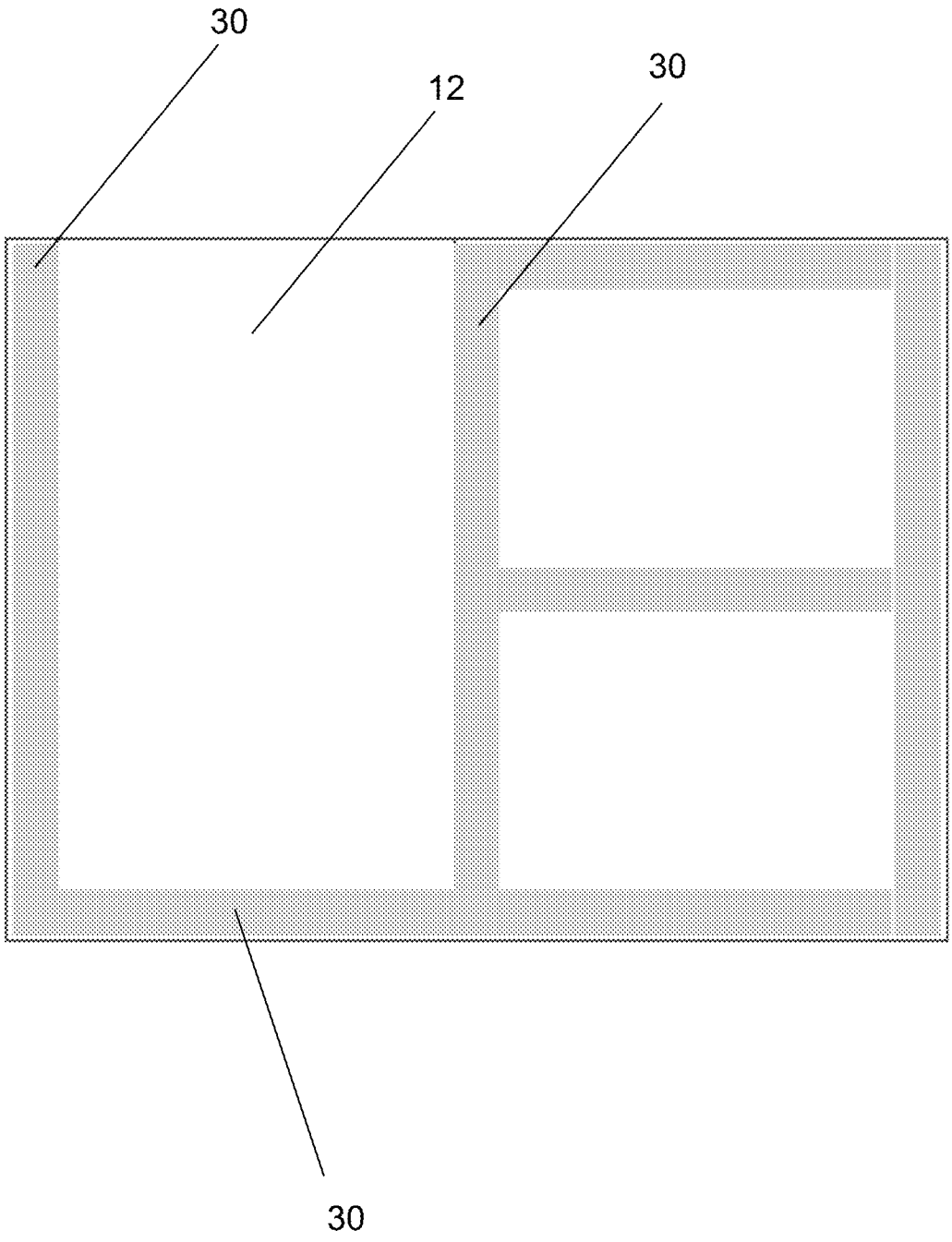
FIGS. 22-23 shows back views of the sign of FIG. 21 with multiple holders.
Figure 23:
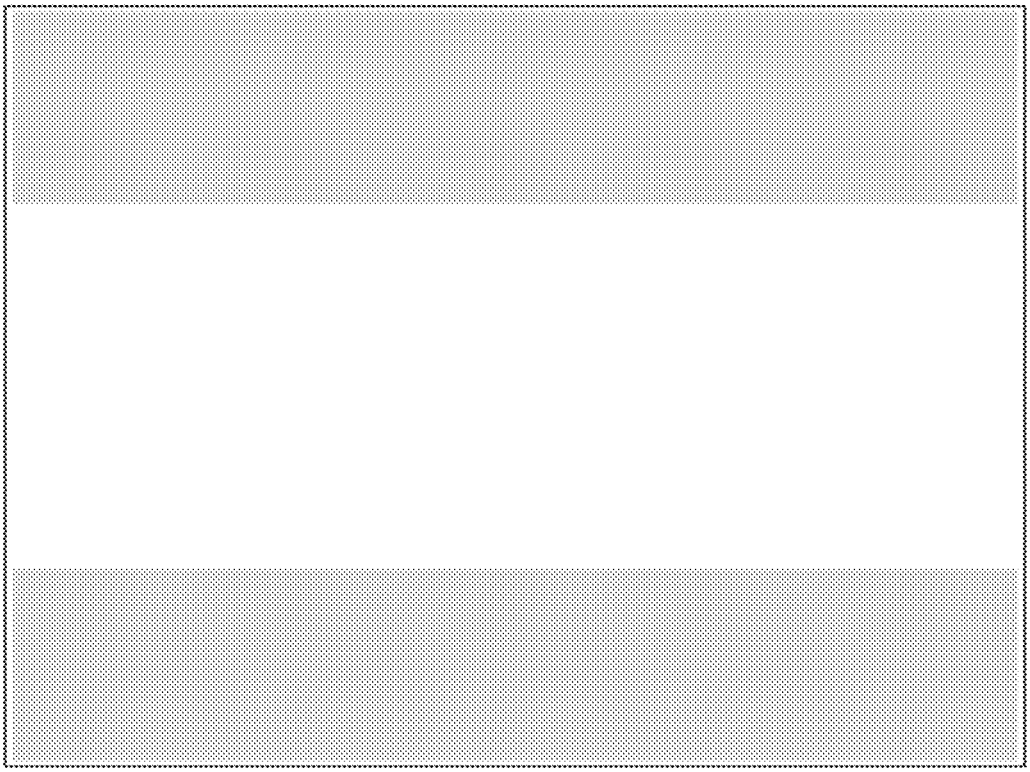
Figure 24:
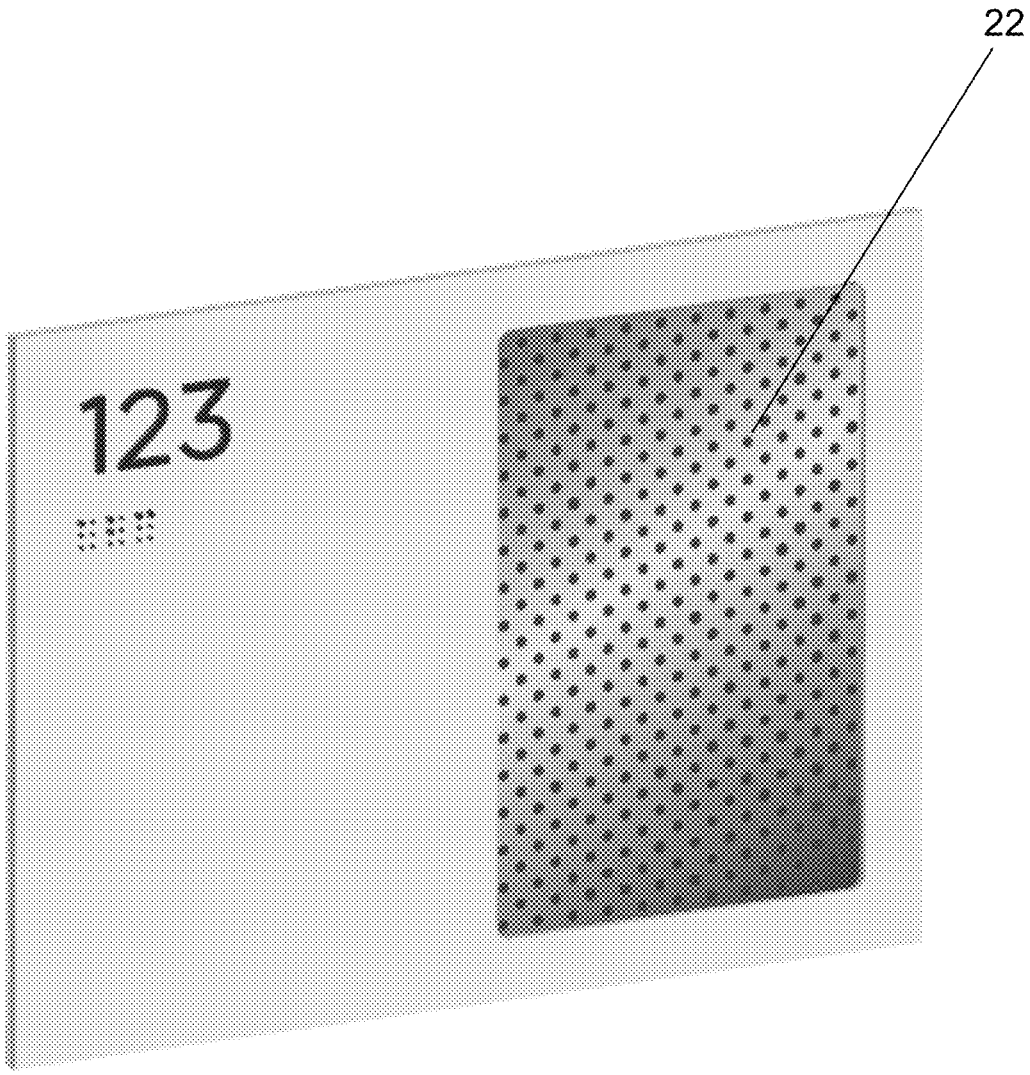
FIGS. 24-30 show front views of the sign of FIG. 21 with various inserts.
Figure 25:
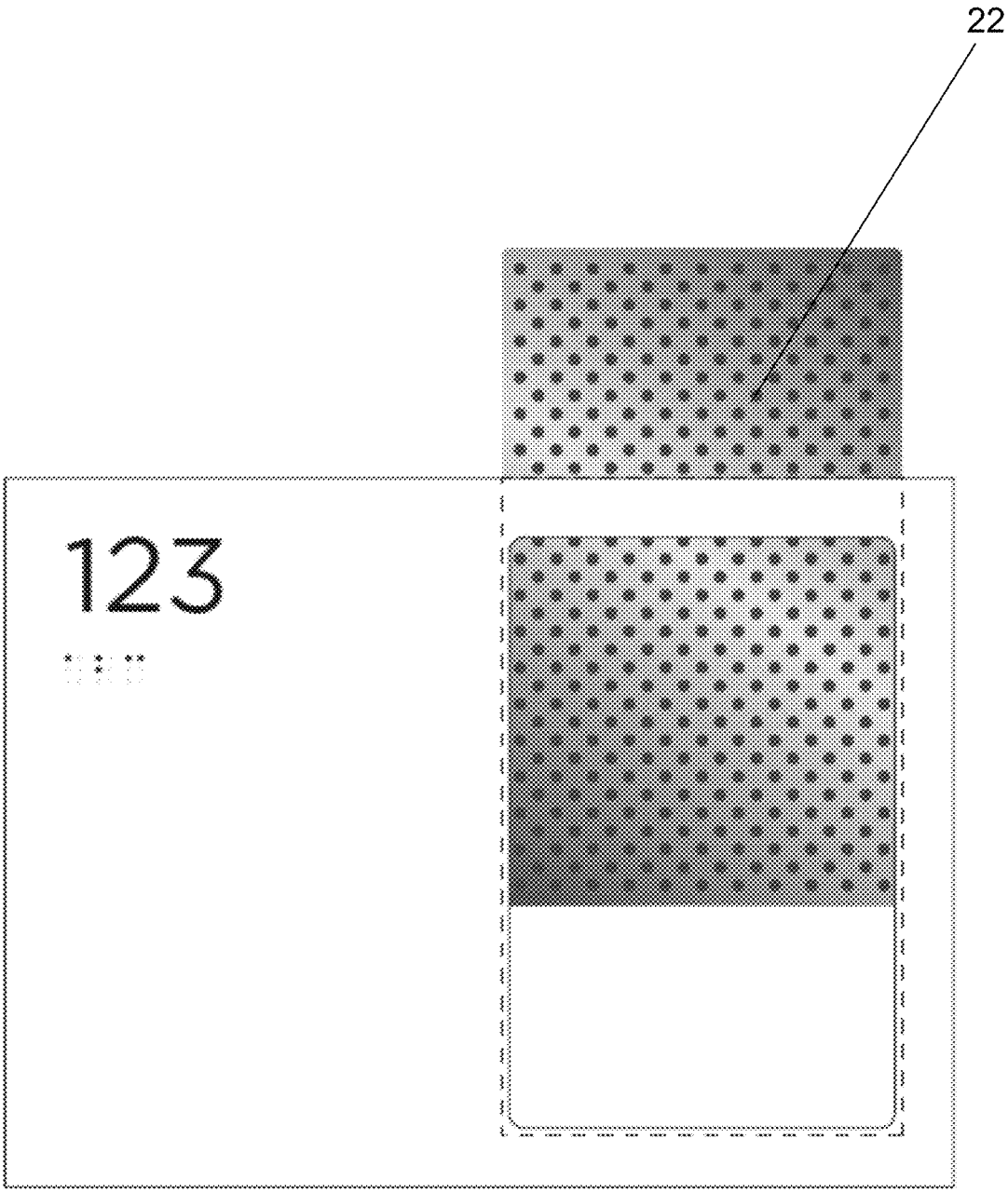
Figure 26:
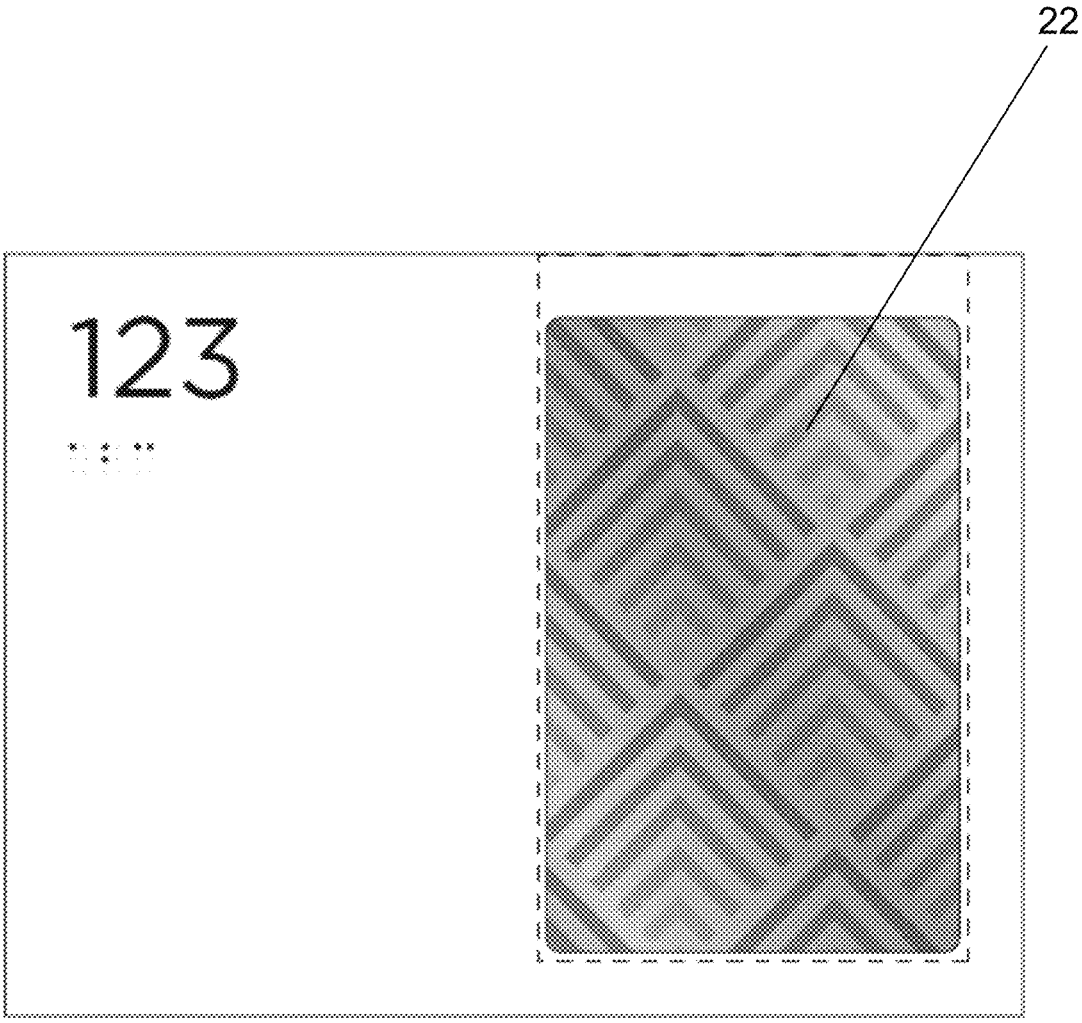
Figure 27:
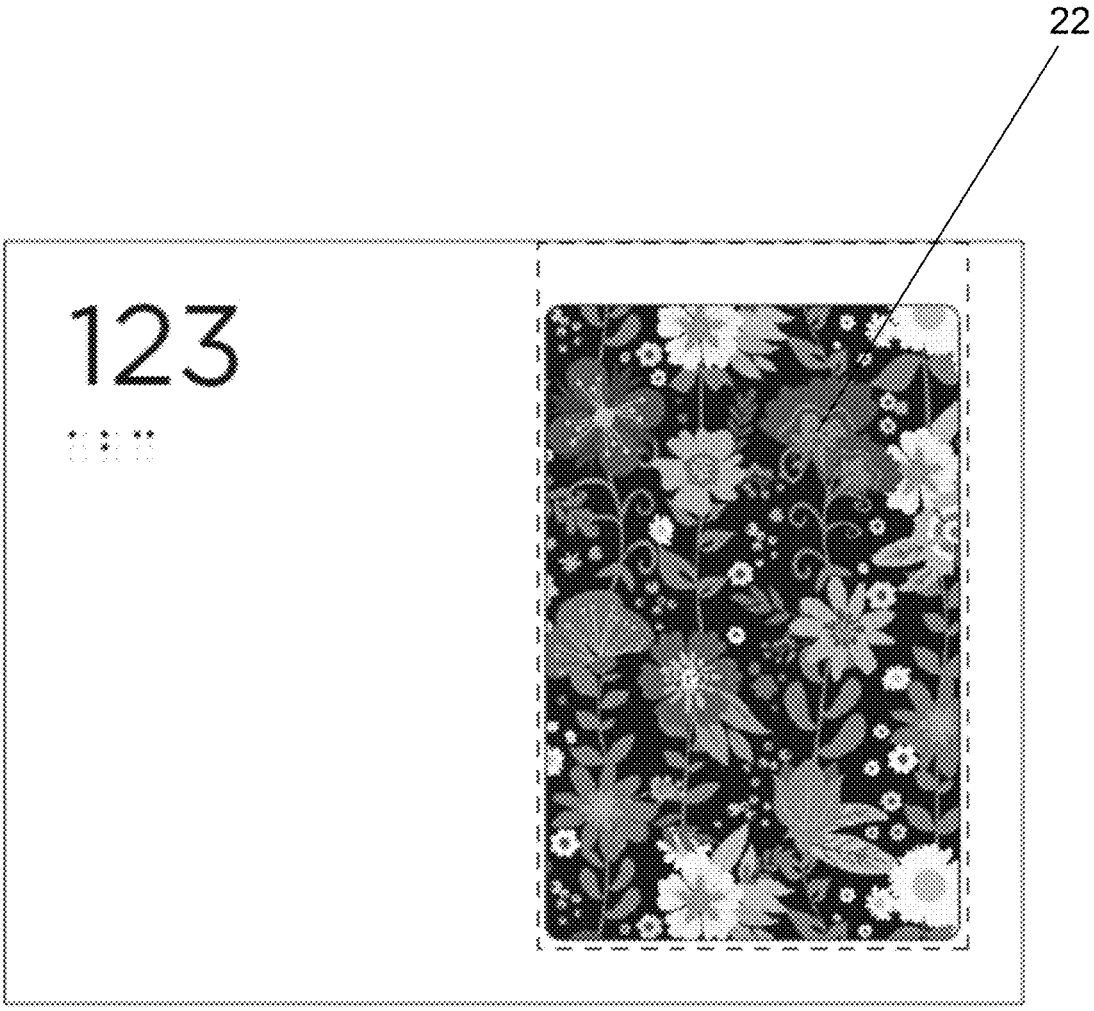
Figure 28:
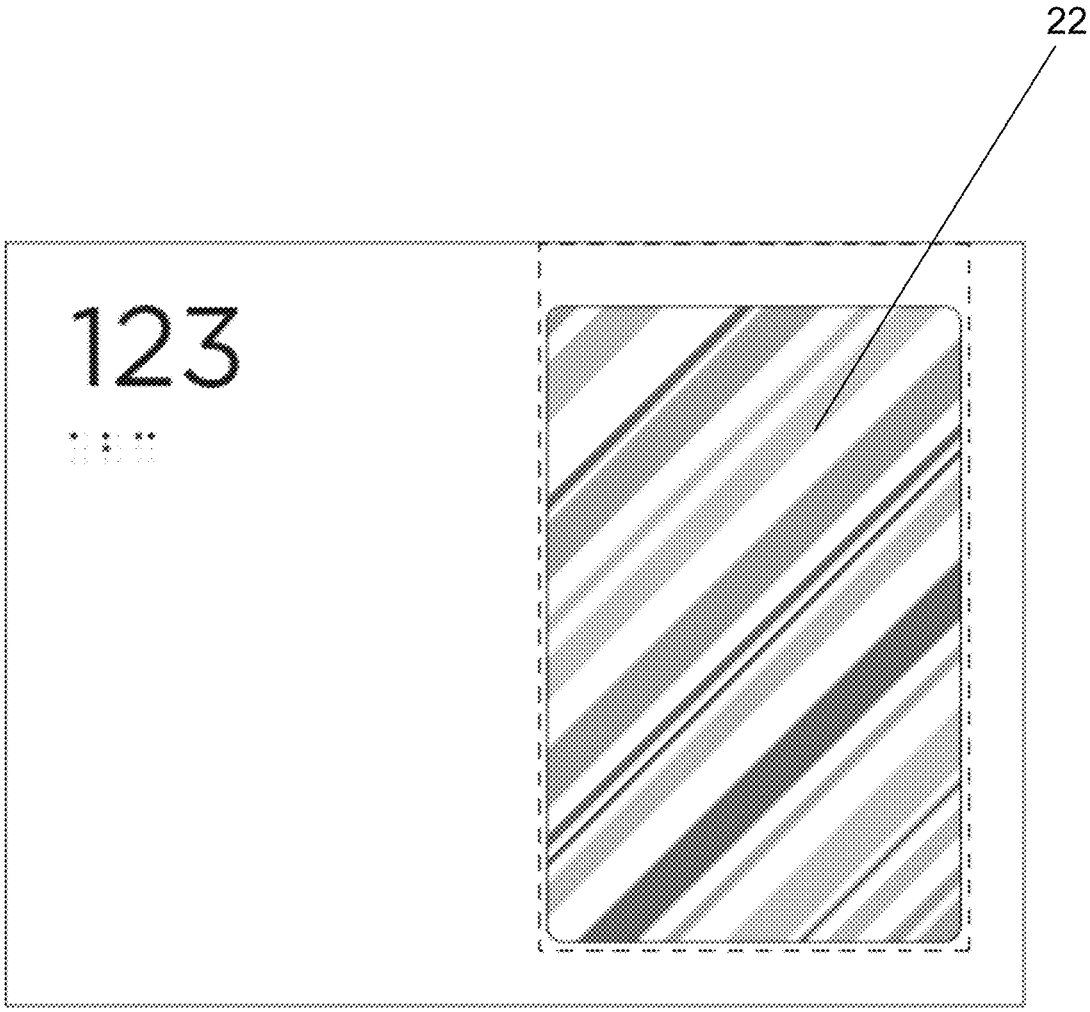
Figure 29:
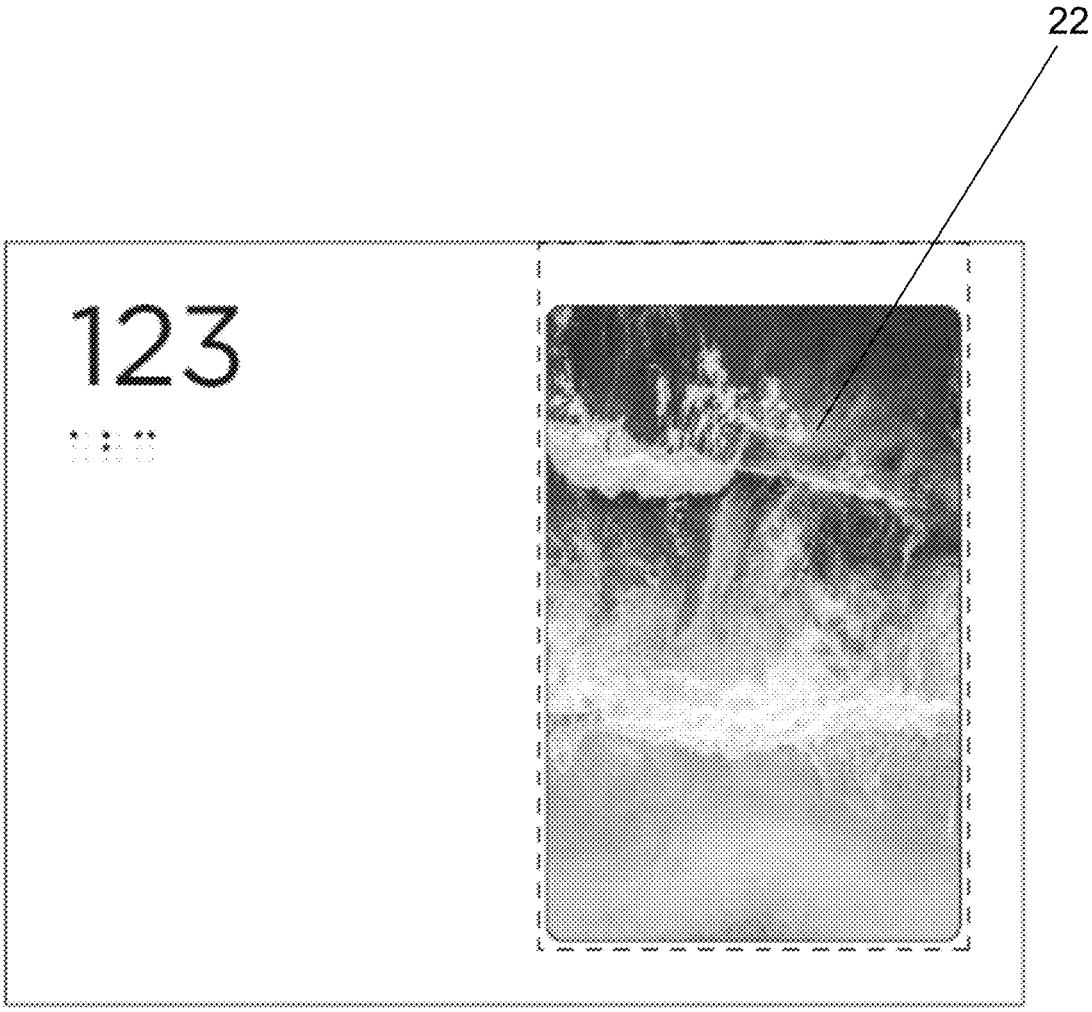
Figure 30:
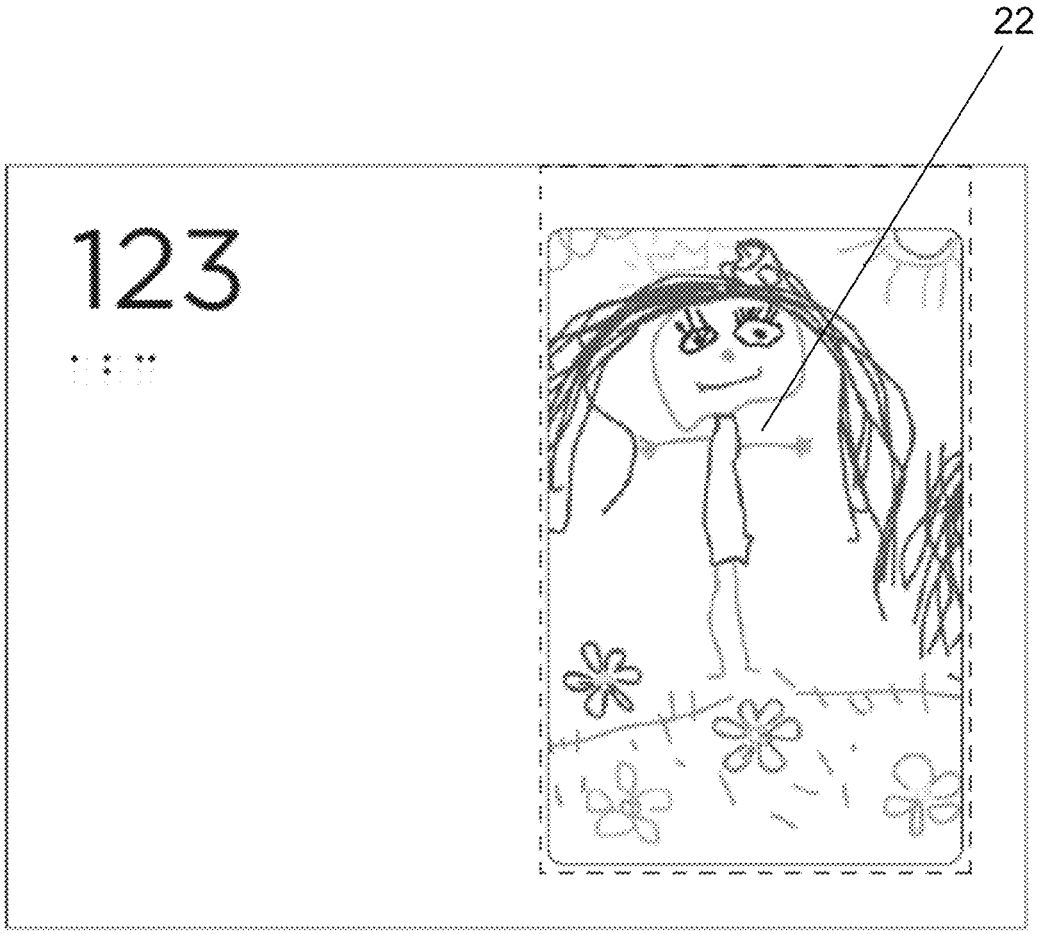

Inserts may comprise one or more colors, images, or patterns, or combinations thereof. Inserts may comprise a single color, image or pattern, or these may be arranged so that particular parts of a color, image or pattern show through the cut-outs. As seen in FIGS. 8 and 9, for example, the colors, images and patterns that show through create the appearance of different articles of clothing on the male and female cut-outs. FIG. 10, in contrast, shows a floral pattern that simply shows through the cut-outs. Inserts may include artwork or images of any type, including hand-drawn art, as seen in FIG. 31.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A device, comprising:

a sign having a front side, a back side, and a cut-out extending from said front side to said back side, said cut-out having a shape representing an image of a person that is visible from said front side, said sign further comprising at least two pieces of tape attached to said back side, said at least two pieces of tape defining a space therebetween that is configured to receive a first removable insert that includes a front face with an ornamental portion thereon, and wherein said ornamental portion on said front face of said first removable insert is visible through said cut-out and creates an appearance of clothing on said image of said person.

2. The device of claim 1, said front side further comprising fixed alphanumeric text and one or more additional cut-outs separate from said alphanumeric text and separate from said cut-out having a shape representing an image of a person, and said back side further comprising additional pieces of tape attached to the back side and positioned to define one or more additional spaces therebetween to receive and removably hold additional inserts each with a front face, separate from the first removable insert, whereby portions of the front faces of the additional inserts are visible through a corresponding one of said one or more additional cut-outs.

3. The device of claim 2, further wherein the front face of one of said one or more additional inserts comprises one or more of a color, a pattern, or an image, positioned on the front face to be visible through the corresponding one of said one or more additional cut-outs.

4. The device of claim 2, further wherein there are two additional cut-outs in the front side, and one additional insert, and the front face of the additional insert comprises a first portion with a first color, pattern or image, and a second portion with a second color, pattern or image, wherein the first portion is visible through one of the additional cut-outs and the second portion is visible through the other additional cut-out.

5. The device of claim 2, wherein the additional pieces of tape comprise three pieces of tape, arranged so that a first and a second piece of said additional tape are parallel with a third piece of said additional tape extending therebetween and orthogonal thereto.

6. The device of claim 2, wherein said pieces of tape are configured to receive and hold a plurality of inserts simultaneously.

7. The device of claim 2, wherein at least two pieces of tape are attached to said back side to define a space therebetween comprising a side opening configured to receive the insert.

8. The device of claim 1, further including a second cut-out extending from said front side to said back side of said sign, said second cut-out being distinct from said cut-out, said first removable insert including a second ornamental portion on said front face that is visible through said second cut-out.

9. The device of claim 8, wherein said ornamental portion and said second ornamental portion are different in appearance.

10. The device of claim 1, wherein said back side further includes a base holder portion configured to receive and hold a bottom edge of said insert.

11. The device of claim 1, wherein said side back side further includes a sleeve or panel in which said insert is received.

12. The device of claim 1, in combination with a plurality of removable inserts, said first removable insert being one of said plurality of removable inserts, each of said plurality of removable inserts being removably insertable into said space, a second removable insert of said plurality of removable inserts including a second ornamental portion that is visible through said cut-out and creates an appearance of a second style of clothing on said image of said person.

13. The device of claim 1, wherein said space is configured to receive and hold a plurality of inserts simultaneously.

* * * * *